US008853620B2

(12) United States Patent
Lange

(10) Patent No.: US 8,853,620 B2
(45) Date of Patent: Oct. 7, 2014

(54) METHODS AND APPARATUS FOR PRODUCING A MASS SPECTRUM

(75) Inventor: Oliver Lange, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 652 days.

(21) Appl. No.: 13/075,067

(22) Filed: Mar. 29, 2011

(65) Prior Publication Data

US 2011/0240841 A1 Oct. 6, 2011

(30) Foreign Application Priority Data

Mar. 31, 2010 (EP) ..... 10158704

(51) Int. Cl.
*H01J 49/00* (2006.01)
*H01J 49/42* (2006.01)

(52) U.S. Cl.
CPC ..... *H01J 49/425* (2013.01); *H01J 49/0036* (2013.01)
USPC ..... 250/282; 250/281; 250/290; 250/291; 250/292; 250/293

(58) Field of Classification Search
USPC ..... 250/281, 282, 290–293
See application file for complete search history.

(56) References Cited

U.S. PATENT DOCUMENTS

| | | | |
|---|---|---|---|
| 4,857,844 | A | 8/1989 | Van Vaals |
| 4,945,234 | A | 7/1990 | Goodman et al. |
| 5,349,359 | A | 9/1994 | Dallaire et al. |
| 5,686,922 | A | 11/1997 | Stankwitz et al. |
| 6,906,320 | B2 | 6/2005 | Sachs et al. |
| 2005/0086017 | A1 | 4/2005 | Wang |
| 2005/0178961 | A1 | 8/2005 | Beu et al. |
| 2009/0278037 | A1 | 11/2009 | Grothe, Jr. |

OTHER PUBLICATIONS

Craig, et al ("Dispersion versus Absorption (DISPA) Method for Automatic Phasing of Fourier Transform Ion Cyclotron Resonance Mass Spectra", Rapid Comm. In Mass Spectrometry, vol. 1, No. 2 (1987), pp. 33-37).*

Kauppinen et al., "Ion Cyclotron Resonance (ICR) Mass Spectrometry, in Fourier Transforms in Spectroscopy," Wiley-VCH, 2002, pp. 124-125.

Comisarow et al., "Selective-phase Ion Cyclotron Resonance Spectroscopy," Canadian Journal of Chemistry, vol. 52 (1974), pp. 1997-1999.

Craig et al., "Dispersion versus Absorption (DISPA) Method for Automatic Phasing of Fourier Transform Ion Cyclotron Resonance Mass Spectra," Rapid Comm. In Mass Spectrometry, vol. 1, No. 2 (1987), pp. 33-37.

Marshall et al., "Fourier Transforms in NMR, Optical, and Mass Spectrometry: A User's Handbook," Elsevier, (1990).

(Continued)

*Primary Examiner* — Michael Maskell
(74) *Attorney, Agent, or Firm* — Charles B. Katz

(57) ABSTRACT

The invention provides a method of producing a mass spectrum, comprising:

obtaining a transient from the oscillation of ions in a mass analyser;

Fourier transforming the transient to obtain a complex spectrum having a real component and an imaginary component; and calculating an enhanced spectrum which comprises a combination of (i) and (ii) wherein (i) comprises a Positive spectrum; and (ii) comprises an Absorption spectrum.

Also provided are an apparatus for producing a mass spectrum suitable for carrying out the method as well as a method of determining a phase correction for a complex spectrum obtained by Fourier transformation from a detected transient obtained from a mass analyser.

26 Claims, 21 Drawing Sheets

(56) References Cited

OTHER PUBLICATIONS

Vining et al., "Phase Correction for Collision Model Analysis and Enhanced Resolving Power of Fourier Transform Ion Cyclotron Resonance Mass Spectra," Analytical Chemistry, 71, (1999), pp. 460-467.

Xian et al., "Improved Broadband Phase Correction of Complex FT-ICR Mass Spectra: Baseline Roll and Apodization," 57th Amer. Soc. Mass Spectrom. Annual Conf. On Mass Spectrometry & Allied Topics, Philadelphia, PA, May 31-Jun. 5, 2009.

* cited by examiner

METHODS AND APPARATUS FOR PRODUCING A MASS SPECTRUM

FIELD OF THE INVENTION

This invention relates to methods and apparatus for producing mass spectra, particularly but not exclusively high resolution mass spectra that are produced by means of a Fourier transform. The invention is preferably though not of necessity partially implemented in computer software.

BACKGROUND OF THE INVENTION

The use of Fourier transforms is a well known and established data processing technique enabling high resolution mass spectra to be obtained from mass spectrometers which acquire data in the form of a transient, for example by detection of an induced oscillating image current. The technique will be referred to herein as Fourier transform mass spectrometry (FTMS) and description of the technique can be found, for example, in Marshall, A. G. & Verdun, F. R., Fourier Transforms in NMR, Optical and Mass Spectrometry; A User's Handbook, *Elsevier,* 1990. Examples of such mass spectrometers include Fourier transform ion cyclotron resonance (FT-ICR) mass spectrometers and electrostatic orbital trapping mass spectrometers such as the Orbitrap™ mass spectrometer from Thermo Fisher Scientific. Such spectrometers offer superior performance in many respects, such as high sensitivity, mass accuracy, resolving power and dynamic range.

In the aforesaid types of mass spectrometer the ions being analysed are urged to undergo oscillatory motion within the spectrometer which induces a correspondingly oscillatory image charge in neighbouring detection electrodes which enables detection of the ions. The oscillatory motion may be of various forms including, for example, circular oscillatory motion in the case of FT-ICR and axial oscillatory motion whilst orbiting about a central electrode in the case of the Orbitrap™ mass spectrometer. The oscillatory image charge in turn induces an oscillatory image current in circuitry connected to the detection electrodes, which is then typically amplified, digitised and stored in computer memory as a transient (i.e. a signal in the time domain). The oscillating ions induce oscillatory image charge and oscillatory current at frequencies which are related to the mass-to-charge (m/z) values of the ions. Each ion of a given mass to charge (m/z) value will oscillate at a corresponding given frequency such that it contributes a signal to the transient which is generally in the form of a sine-shaped wave at the given frequency. The total detected image current of the transient is then the resultant sum of the image currents at all the frequencies present (i.e. a sum of sine waves signals). Fourier transformation of the transient yields the oscillation frequencies associated with the particular detected oscillating ions and from the frequencies the m/z values of the ions can be determined (i.e. the mass spectrum) by known equations.

Fourier transformation of the digitised transient is a fast processing method but requires relatively long detection times to achieve high resolving powers. While being adequate for most present-day Liquid Chromatography (LC) separations, the mass spectra acquisition rate for the highest resolving power needs to be increased to address ever faster separations methods. It is thus desirable to further increase the resolving power for a given acquisition time. However, there exist obstacles to the improvement of resolving power. Technical solutions like e.g. increase of the magnetic field in FT-ICR-MS or changes to the field geometry and voltages of an Orbitrap-MS may be difficult or prohibitively expensive.

The Fourier transformation of the transient provides a complex value for each point in the frequency domain (a complex spectrum), which is usually represented as a pair of two values: magnitude and phase or real (Re) and imaginary (Im) component. A special case is the representation of the complex spectrum as 'absorption' and 'dispersion' spectra. Here, in analogy to optical spectroscopy, the complex plane is turned such that the phase at the centre of the peak is zero. In this representation the first 'absorption' part gives a spectrum that maximizes at the centre of the peak and the second 'disperison' part gives a spectrum that has a zero-crossing at the centre of the peak.

Whilst the absorption spectrum can theoretically be used for forming the frequency and mass spectrum, as is the case in FT-NMR and FT-IR spectroscopy, in practice in the area of Fourier transform mass spectrometry, as described below, usually the so-called magnitude spectrum is displayed and used for data analysis, even though a magnitude spectrum has a significantly larger peak width than the absorption spectrum. For example a peak width for a Lorentzian peak shape is broadened by a factor of $\sqrt{3}$by the magnitude calculation.

Without perfect phase correction a lessening of peak position accuracy is caused by the phase variation with frequency of the various components constituting the transient which results, e.g., from the typical time delays inherent between excitation and/or injection of ions into the mass analyser and the start of detection of the transient. This phase variation problem produces asymmetrical peak shapes for the real component following the Fourier transformation. A totally symmetrical peak is only obtained when the phase angle at the start of the transient is zero. In order to restore symmetry to the peaks in the frequency and hence mass domains, FTMS data systems have conventionally used the so-called magnitude spectrum given by:

$$\text{Magnitude}(p)=[\text{Re}(p)^2+\text{Im}(p)^2]^{1/2} \qquad \text{Equation (1)}$$

where Magnitude(p) is the magnitude value at a point p; Re(p) is the real component from the Fourier transformation at point p; and Im(p) is the imaginary component from the Fourier transformation at point p. The point p is typically a point in the frequency (f) domain or a domain related thereto such as the m/z domain. The m/z value can be derived from the frequency of the magnitude peak's centre. The use of the magnitude spectrum, which amounts to disregarding the phase information, yields symmetrical peaks in the frequency/mass spectra but suffers from reduced resolving power compared to the pure absorption spectrum.

Sometimes, especially when computational expense is an issue, the power spectrum ($\text{Power}(p)=[\text{Re}(p)^2+\text{Im}(p)^2]$) or an approximation to the magnitude spectrum is used instead of the magnitude spectrum. A frequently used and considerably accurate approximation to $[\text{Re}(p)^2+\text{Im}(p)^2]^{1/2}$ is, for example, to use (a) Estimate=0.96|Re(p)|+0.398|Im(p)|for |Re(p)|>|Im(p)|, and (b) Estimate=0.96|Im(p)|+0.398|Re(p)| otherwise where |Re(p)| and |Im(p)| are respectively the absolute value of the real (or imaginary) component. This is especially convenient after an initial phase correction has been done, because then the relation of Re and Im to each other are known and (a) or (b) can be applied without first having to test for whether |(Re(p)|>|Im(p)|.

For convenience herein it will refer to a spectrum from the class of the thus generated spectra (e.g. any of Power spectrum, Magnitude spectrum, estimates to the Magnitude spectrum or Power spectrum, or other combinations of real and imaginary parts of the Fourier transform that give a similar effect to the Magnitude spectrum or Power spectrum), i.e. a spectrum which comprises a function of real and imaginary components of the complex spectrum where substantially all points have the same sign, as a "Positive Spectrum".

Various approaches to tackling the phase problem therefore have been proposed in the prior art, including phase correction, the aim of which has been to try to ensure that each of the frequency components exhibits a peak shape close to a pure absorption peak shape.

In U.S. Pat. No. 7,078,684, an FT-ICR system is described in which hardware is designed to minimise the delay between ion excitation and detection by synchronising these steps so as to be simultaneous and software deconvolutes the Fourier transformed frequency domain data using complex division to obtain a separate absorption spectrum. This enables use of the symmetrical absorption spectrum for obtaining the mass spectrum and is reported to improve the resolving power by a factor of 2 compared to the use of the magnitude spectrum. However, the approach described in U.S. Pat. No. 7,078,684 is not useful in the case of electrostatic orbital trapping mass spectrometers like the Orbitrap™ mass analyser operated without excitation but instead with excitation-by-injection, since current ion injection methods for injecting ions into the mass analyser involve changing the trapping field during injection so that the oscillation frequencies of the ions during this initial injection period are also changing. In the case of the Orbitrap™ mass analyser therefore, the time delay between ion injection and detection is difficult to minimise. Additionally the method of U.S. Pat. No. 7,078,684 proves, regardless of analyser type, to suffer from sidelobe problems (discussed further below) and mass accuracy problems relating to the limited quality of phase correction.

In the prior art such as B. A. Vining, R. E. Bossio and A. G. Marshall, *Anal. Chem.,* 1999, 71 (2), pp 460-467 algorithms for phase correction of ion oscillations in the acquired spectra have enabled the absorption spectrum to be used for conversion into mass spectra instead of magnitude spectra and as a consequence has improved the resolving power by a factor of 2 compared to the use of the magnitude spectrum.

However, a problem of simply applying a phase correction to the data is that transformed peaks in the resultant frequency or mass spectra suffer from a problem of spectral artefacts such as large sidelobes beside peaks and a baseline curve or roll can be introduced. Sidelobes can be a particular problem if a second or further peak is in the position of one of the sidelobes and so becomes disturbed or even lost from the spectrum. These problems are inherent in the methods described above and the solution in those methods is to hide the appearance of sidelobes in the spectrum by use of "half-Hanning" apodisation and accept a high degree of spectral leakage, leading to distortion of neighbouring peaks over a broader region and an overall increase in "noise". In addition, the sidelobe problem is not really solved but just hidden under the spectral leakage of other peaks. The displayed data may also be subject to baseline clipping which improves the appearance of the spectra but also leads to errors. Another negative impact of a simple linear phase correction is to reduce mass accuracy due to mass dependent phase variations which is not addressed by those methods.

In the wider art of Fourier transforms applying some form of window ("windowing"), also known as apodisation, to the pre-transformed time domain data is known as a means to reduce the appearance of sidelobes in the transform data, e.g. Hamming, Hanning (Hann) or half-Hanning (half-Hann) apodisation. Description of such techniques can be found, e.g., in Lee, J. P. & Comisarow, M. B., Advantageous Apodization Functions for Magnitude-Mode Fourier Transform Spectroscopy, *Applied Spectroscopy,* 1987, 41, 93-98.

A problem with windowing or apodisation, however, is that the transformed peak becomes broadened, i.e. the resolving power is lessened. There have also been described various approaches to the reducing of peak sidelobes in Fourier transformations such as those methods disclosed in U.S. Pat. No. 5,349,359 and U.S. Pat. No. 5,686,922 which are methods of sidelobe reduction for use in radar systems and are not primarily disclosed for use in mass spectrometry. The methods of those references do not use the pure "absorption" spectrum but use the magnitude spectrum, combining apodised and unapodised data to construct a peak that is not broadened by apodization and has no or reduced sidelobes.

It therefore remains a problem to be able to more effectively and efficiently achieve increased resolving power, e.g. as provided by a pure absorption spectrum, especially to be able to produce cleaner peaks with reduced or removed significant sidelobes and a lower extent of spectral leakage, together with higher resolving power.

In view of the above background, the present invention has been made.

SUMMARY OF THE INVENTION

According to an aspect of the present invention there is provided a method of producing a mass spectrum, comprising:

obtaining a transient from the oscillation of ions in a mass analyser;

Fourier transforming the transient to obtain a complex spectrum; and calculating an enhanced spectrum which comprises a combination of (i) and (ii) wherein (i) comprises a Positive spectrum obtained from the complex spectrum; and (ii) comprises an Absorption spectrum obtained from the complex spectrum.

According to another aspect of the present invention there is provided an apparatus for producing a mass spectrum, comprising:

a mass analyser for causing ions to oscillate therein;

a detector for obtaining a transient from oscillation of the ions in the mass analyser; and an information processor for:

Fourier transforming the transient to obtain a complex spectrum; and calculating an enhanced spectrum which comprises a combination of (i) and (ii) wherein (i) comprises a Positive spectrum obtained from the complex spectrum; and (ii) comprises an Absorption spectrum obtained from the complex spectrum.

The apparatus according to the present invention forms part of a mass spectrometer. Accordingly, in yet another aspect of the present, invention there is provided a mass spectrometer comprising the apparatus according to the present invention.

In a related aspect, the present invention provides an apparatus for producing a mass spectrum by Fourier transformation, comprising:

an ion trap;

an ion injection device for injecting ions into the ion trap whereby the ions are induced to oscillate within the ion trap upon injection; and an information processor for Fourier transforming a transient produced by the oscillation of the ions within the ion trap to obtain a complex spectrum and for calculating an enhanced spectrum which comprises a combination of (i) and (ii) wherein (i) comprises a Positive spectrum obtained from the complex spectrum; and (ii) comprises an Absorption spectrum obtained from the complex spectrum.

The enhanced spectrum is a spectrum with enhanced, i.e. higher, resolution compared to the magnitude spectrum. The enhanced resolution spectrum calculated by the present invention is advantageously a high resolution mass spectrum. The invention may for example provide an improvement in resolving power of between 1.4 and 3.5 fold, or in some cases more, e.g. 4 fold for a given data acquisition time. It is typical to achieve a resolution enhancement of about 2 fold compared to the magnitude spectrum using the present invention. Accordingly, in an alternative form, the method of producing a mass spectrum according to the present invention can be expressed as a method of increasing the resolution of a mass spectrum and/or a mass spectrometer. This allows obtaining much higher resolving powers for a given acquisition time or a similar resolving power to conventional methods with much shorter acquisition times. Beneficially, the resolution improvement gained by the invention can be used to reduce (e.g. halve) the transient acquisition time. The invention thereby provides a method and apparatus which can be used to increase the speed of a mass spectrum acquisition while maintaining a given resolution. Accordingly, the invention may be a method of increasing the speed of a mass spectrometer for a given resolution. Advantageously, the invention enables such a mass spectrum of high resolving power to be produced and at the same time the invention can inherently reduce the problem of sidelobes and hence reduce spectral leakage. Thus, in addition, more information may be retained in the mass spectrum produced by the present invention. Reduction of sidelobes and consequent reduction of spectral leakage are accompanying features of the present invention. In other words, the invention delivers the improved resolution of the "absorption" spectrum but alleviates disadvantages associated with using that spectrum alone, especially concerning spectral leakage problems associated with sidelobes in apodised absorption spectra.

The mass analyser for use in the present invention may be any FT mass analyser (i.e. any mass analyser requiring a Fourier transformation to produce a mass spectrum, herein termed an FT mass analyser), preferably an FT-ion trap, including without limit, an FT-ion trap with image current detection, RF FT-ion trap with image current detection, FT-ICR mass analyser, or an electrostatic orbital trapping mass analyser (e.g. Orbitrap™ mass analyser) but may be any other FT mass analyser. The mass analyser for use in the present invention is preferably an ion trap, e.g. an FT-ICR mass analyser, an electrostatic orbital trapping (e.g. Orbitrap™) mass analyser, a "Cassinian" trap (e.g. as described in GB 2448413 A), a linear trap and a "reflectron" trap (e.g. as described in U.S. Pat. No. 6,888,130). Preferably the mass analyser is an FT-ICR mass analyser or an electrostatic orbital trapping (e.g. Orbitrap™) mass analyser, most preferably an electrostatic orbital trapping (e.g. Orbitrap™) mass analyser. In relation to an e.g. Orbitrap™ mass analyser, the mass analyser of the present invention may be any mass analyser in which ions oscillate axially along an electrode within the mass analyser whilst orbiting around the electrode, more specifically in which ions oscillate axially along the mass analyser whilst orbiting around an inner electrode (i.e. any electrostatic orbital trapping mass analyser). The present invention may be any mass analyser in which ions oscillate within a hyper-logarithmic electric field, as in the Orbitrap™ mass analyser. Operation of Orbitrap™ mass analysers is described for example in U.S. Pat. No. 5,886,346 and Olsen, J. V.; Schwartz, J. C.; Griep-Raming, J.; Nielsen, M. L.; Damoc, E.; Denisov, E.; Lange, O.; Remes, P.; Taylor, D.; Splendore, M.; Wouters, E. R.; Senko, M.; Makarov, A.; Mann, M. & Horning, S. A Dual Pressure Linear Ion Trap Orbitrap Instrument with Very High Sequencing Speed *Mol Cell Proteomics,* 2009, 8, 2759-2769. The invention is used with a step of causing ions to oscillate in the mass analyser in order that a transient may be obtained therefrom. The step of causing ions to oscillate in the mass analyser is a well known and necessary feature of FT mass analysers. Similarly, means and methods for causing ions to oscillate in the mass analyser are well known and conventional means and methods for causing ions to oscillate in the mass analyser can be used in the present invention. For example, the use of appropriate ion injection into a suitable hyper-logarithmic electric field as in the Orbitrap™ mass analyser will cause the ions to commence oscillation within the mass analyser (i.e. oscillation upon injection) and oscillation continues in the hyper-logarithmic electric field. In FT-ICR mass analysers the application of a magnetic field and an electric excitation field is employed to cause the ions to oscillate.

Preferably, the method comprises injecting a packet of ions into the mass analyser prior to causing the ions to oscillate. The mass analyser, which is preferably an FT mass analyser, more preferably an FT-ion trap, and especially an Orbitrap™ mass analyser, preferably comprises an ion injection device for injecting a packet of ions into the mass analyser. The injection device most preferably injects the ions into the mass analyser simultaneously. The ion injection device may be, e.g., a linear ion trap, curved linear ion trap (also known as a C-trap, for example as described in WO 2008/081334), orthogonal accelerating device, or other known ion injection device for injecting a packet of ions into an ion trap.

A transient is obtained from the oscillation of the ions in the mass analyser. Herein the transient refers to a detected response signal in the time domain caused by oscillation of the ions in the analyser. Obtaining the transient preferably comprises using a detector for detecting the ion oscillation in the mass analyser. The detector preferably comprises an image current detector, i.e. which detects an image current induced by the ion oscillation.

The detector used for obtaining the transient preferably comprises one or more electrodes (herein termed detection electrodes) for detecting the oscillation of the ions in the mass analyser, preferably in the form of an image charge induced in the one or more detection electrodes by the oscillating ions. The one or more detection electrodes of the detector are preferably connected to circuitry for detecting the induced image charge wherein in use an image current is induced in the circuitry connected to the detection electrodes. The image current is then preferably amplified, digitised and stored as the transient. Thus, typically the image current is amplified by an amplifier, digitised by a digitiser and stored in computer memory as the transient. An example of such a detector is found, e.g., in an FT-ICR mass analyser and an Orbitrap™ mass analyser.

It can be seen that the method and apparatus of the present invention are for producing a mass spectrum by Fourier transformation. Preferably, any or all of the steps of Fourier transforming the transient to obtain the complex spectrum, and calculating the enhanced spectrum, calculating a phase correction and/or applying the phase correction and/or any other steps of the invention comprising running of an algorithm or performing a calculation described herein are performed using an information processor. Herein the term information processor means an electronic device for processing information or data and the term encompasses one or more individual information processors. The information processor may be either programmable (i.e. having one or more programmable elements) or non-programmable (i.e. not having a programmable element) or have both one or more programmable elements and one or more non-programmable elements. The information processor may be a general purpose electronic processor (i.e. capable of performing other steps than the steps described herein) or a dedicated electronic processor (i.e. dedicated to the steps described herein). Examples of information processor include, without limitation, a computer or dedicated electronic processor, e.g. DSP, ASIC, FPGA and the like. A preferred information processor for the present invention comprises a computer. Accordingly, the steps of Fourier transforming the transient to obtain the complex spectrum, and calculating the enhanced spectrum, and optionally any calculating of a phase correction and/or applying the phase correction and/or any steps of the invention comprising running of an algorithm or performing a calculation are performed may be implemented in computer software. Alternatively such steps may be performed using specifically designed hardware to facilitate the processing of data, e.g. a dedicated electronic processor which does not use computer software. Preferably such steps of the present invention are performed with the aid of a computer running computer software. In general, any steps of the present invention which involve processing data are preferably implemented in computer software. The invention may therefore be implemented, e.g. partially in computer software.

In a supplementary aspect, the present invention provides a computer program having elements of program code which, when executed, carry out the data processing methods previously described. The present invention thus provides a computer program having elements of program code which, when executed, carry out the steps performed by the information processor. Preferably, the supplementary aspect of the present invention provides a computer program having elements of program code which, when executed, carry out at least the Fourier transformation and the calculation of the enhanced spectrum of the present invention. In still another aspect, the present invention provides a computer readable medium when carrying said program.

The step of Fourier transforming the transient preferably comprises Fourier transforming using a fast Fourier transform (FFT) for efficiency. Fourier transforms, including FFTs, are well known in the FT-MS art and conventional transforms may be used in the present invention.

The step of Fourier transforming the transient to obtain a complex spectrum is preferably Fourier transforming to obtain a complex spectrum in the frequency domain and may optionally additionally comprise converting the complex spectrum in the frequency domain to a complex spectrum in another related domain such as the m/z domain. Thus, the complex spectrum is preferably the complex spectrum in the frequency domain but may be the complex spectrum in another related domain, e.g. such as the m/z domain, derived from the complex spectrum in the frequency domain. The phase correction which is applied to the complex spectrum accordingly may be applied to the complex spectrum in the frequency domain or the complex spectrum in another domain related to the frequency domain, such as the m/z domain. Herein, a reference to the complex spectrum refers to any spectrum following the Fourier transformation step. Preferably, conversion to the m/z domain from the frequency domain is performed after the phase correction has been applied.

The complex spectrum obtained from the Fourier transformation has a real component and an imaginary component. For the step of calculating the enhanced spectrum it is required to use data from a spectrum (i) which comprises a function of the real component and imaginary component of the complex spectrum in the form of a Positive spectrum.

The Positive spectrum is a spectrum which comprises a function of real and imaginary components of the complex spectrum where substantially all points have the same sign (i.e. substantially all points have positive sign or substantially all points have negative sign). The Positive spectrum for example, is preferably any of the Power spectrum, Magnitude spectrum, estimates to the Magnitude spectrum or Power spectrum, or other combinations of real and imaginary parts of the Fourier transform that give a similar effect to the Magnitude spectrum or Power spectrum. Such spectra are now described in more detail.

Such a spectrum (i), for a point p, preferably comprises a function of $$\mathrm{Re}(p)^2+\mathrm{Im}(p)^2$$

where Re(p) is the real component from the Fourier transformation (i.e. the real component of the complex spectrum) at point p; and Im(p) is the imaginary component from the Fourier transformation at point p (i.e. the imaginary component of the complex spectrum). The point p may be a point in the frequency f domain or domain related thereto such as the m/z domain. Herein functions and equations expressed as functions of frequency include the equivalent functions and equations expressed as functions of a domain related to frequency such as m/z. Therefore, such functions and equations herein encompass corresponding functions and equations in all other related domains within their scope.

Such a spectrum (i) is more preferably the magnitude spectrum, which is a function of the real component and imaginary component of the complex spectrum according to Equation (1) above. i.e.

$$\mathrm{Magnitude}(p)=[\mathrm{Re}(p)^2+\mathrm{Im}(p)^2]^{1/2}$$

It is also possible to use other functions to provide a spectrum (i) and another example of a suitable function is the so-called power spectrum which is the square of the magnitude spectrum, i.e.

$$\mathrm{Power}(p)=\mathrm{Re}(p)^2+\mathrm{Im}(p)^2 \qquad \text{Equation (4)}$$

where Power(p) is the power value at point p and Re(p)+Im(p) are defined above.

Sometimes, especially when computational expense is an issue, an approximation to the magnitude spectrum or indeed the power spectrum is used instead of the magnitude spectrum. A frequently used and surprisingly accurate approximation to $[\mathrm{Re}(p)^2+\mathrm{Im}(p)^2]^{1/2}$ is, for example, to use (a) Estimate=0.96|Re(p)|+0.398|Im(p)| for |Re(p)|>|Im(p)|, and (b) Estimate=0.96|Im(p)|+0.398|Re(p)| otherwise (this is especially convenient after an initial phase correction has been done, because then the relation of Re and Im to each other are known and (a) or (b) can be applied without first having to test for whether |Re(p)|>|Im(p)|).

In other embodiments, the spectrum (i) may be a function of the real component and imaginary component of the complex spectrum other than $\mathrm{Re}(p)^2+\mathrm{Im}(p)^2$. Throughout this description, however, it is preferred that spectrum (i) is the magnitude spectrum or the power spectrum, or an estimation thereof, but is most preferred that spectrum (i) is the magnitude spectrum. The spectrum (i), e.g. the magnitude or power spectrum, may be derived from the real component and imaginary component of the complex spectrum before phase correction has been applied to the complex spectrum or after the phase correction has been applied to the complex spectrum since the Positive spectrum, such as the magnitude or power spectrum, is unchanged by the phase correction.

For the step of calculating the enhanced spectrum it is further required to use data from a spectrum (ii) which comprises the Absorption spectrum, i.e. the real or imaginary component of the complex spectrum after a phase correction has been applied to it. Further details and examples of the phase correction are given below. Herein, the Absorption spectrum means a component of the complex spectrum after a phase correction has been applied to it which has a maximum substantially at the centre of a peak. The Absorption spectrum is preferably the real component of the complex spectrum after a phase correction has been applied.

The enhanced spectrum comprises a plurality of points (e.g. frequency points or m/z points) and is a combination of (i) and (ii). Most preferably, the enhanced spectrum is a weighted sum of (i) and (ii) for each point in the enhanced spectrum. It will be appreciated that the order of certain steps in calculating the enhanced spectrum is not critical and various orders of steps together with associated algorithms may be used, some examples of which are given below.

The calculation of spectrum (i) may comprise calculation of the whole spectrum (i) in one step (e.g. one continuous sequence), e.g. the magnitude or power spectrum may be calculated for all points (frequency or related points such as m/z points) in one sequence using a suitable algorithm before combining with spectrum (ii). Such a calculation may be preferred from the viewpoint of simplicity. The spectrum (i) calculated in such a manner may then be combined with the spectrum (ii) to produce the enhanced spectrum. The spectrum (ii) may likewise be calculated for all points (frequency or related points such as m/z points) in one sequence using a suitable algorithm before combining with spectrum (i). Spectrum (i) may be calculated before spectrum (ii) or alternatively spectrum (ii) may be calculated before spectrum As one alternative to the foregoing manner of calculation of spectrum (i) and spectrum (ii), each point in the spectrum (i) and spectrum (ii) may instead be calculated individually and then they are combined to obtain the corresponding point in the enhanced spectrum before another point in each of the spectrum (i) and spectrum (ii) is calculated individually and then combined to obtain another point in the enhanced spectrum and so on until the enhanced spectrum is obtained.

The points in the spectrum (i) or (ii) may be calculated in any order, not necessarily in simple sequential order (e.g. ascending or descending frequency or m/z order). Likewise, the points in the enhanced spectrum may be calculated in any order, not necessarily in simple sequential order.

It will be appreciated that further means of calculating spectrum (i), spectrum (ii) and the enhanced spectrum, e.g. further means between the means described above, are also possible. Accordingly, in particular, no time order or particular algorithm is implied to limit the manner of calculating spectrum (i), spectrum (ii) and the enhanced spectrum.

In view of the above it will be appreciated that the invention may comprise the use of various algorithms for executing the steps of the method. For example, where the spectrum (i) and/or spectrum (ii) is/are each calculated in one step, there may be an algorithm for performing each such step and there may then be another algorithm for calculating the enhanced spectrum. Alternatively, calculating spectrum (i) and/or spectrum (ii) and/or the enhanced spectrum may be combined into a single algorithm, e.g. as when each point in the spectrum (i) and spectrum (ii) is calculated individually for each enhanced spectrum point. All calculations and algorithms are preferably run on a computer.

Spectrum (ii) comprises the real or imaginary component of the complex spectrum after a phase correction has been applied to it. More preferably, spectrum (ii) comprises the real component of the complex spectrum after a phase correction has been applied to it. Especially, the spectrum (ii) is the real or imaginary component of the complex spectrum after a phase correction has been applied to it, i.e. without additional factors.

The phase correction may be applied to create the absorption or dispersion component or both (i.e. to the whole complex spectrum). Herein, for convenience, it will often refer to applying the phase correction to the complex spectrum which means applying the phase correction to only create the absorption component of the complex spectrum or to create the whole phase corrected complex spectrum.

For example, given a point p={Re(p), Im(p)} of a complex spectrum, for a phase correction by an angle $\phi$, the corresponding point q={Ab(q), Di(q)} of the Absorption (Ab) and Dispersion (Di) spectrum may then be calculated as:

$$Ab(q)=Re(p)*\cos(\phi)+Im(p)*\sin(\phi);$$

$$Di(q)=-Re(p)*\sin(\phi)+Im(p)*\cos(\phi);$$

It may be sufficient for most practical purposes to only calculate the Absorption spectrum, unless it is desired to perform combined processing or to use the dispersion term for further enhancements (e.g. determining the peak position from the zero-crossing of the dispersion spectrum).

The phase correction applied may comprise any suitable phase correction method, including any suitable phase correction method known in the art, such as those described in Vining et al and US 2009/0278037 A1, or those based on linear prediction methods. The phase correction which is applied is preferably applied by multiplying all points in the complex spectrum by a complex phase correction value, or equivalently pointwise multiplying the real and imaginary component of the complex spectrum, by a phase correction matrix to obtain the phase corrected complex spectrum or phase corrected real and/or imaginary component. Known phase corrections may be used.

Preferably, the method comprises applying the phase correction to the complex spectrum using a function of $t_0$ and more preferably a function of $t_0$ and $\phi_0$ as herein defined. Still more preferably, the phase correction is applied to the complex spectrum by multiplying points of the complex spectrum by a phase correction matrix which is a function of $t_0$, and more preferably is a function of $t_0$ and $\phi_0$, to obtain the phase corrected complex spectrum. The phase correction most preferably comprises pointwise applying of a correction e.g. by multiplication of every (complex) data point with a complex correction value C(f) having substantially the following properties:

$$C(f): \{\text{Magnitude}(f)=1;\ \text{Phase}(f)=\phi_0+2\pi f t_0\} \qquad \text{Equation (2)}$$

where:

Magnitude(f) is the component for the magnitude of a frequency component f of the complex spectrum;

Phase(f) is the component for the phase of a frequency component f of the complex spectrum;

$\phi_0$ is the phase (radians) of the frequency component f at $t_0$;

f is the frequency (seconds$^{-1}$) of the frequency component; and $t_0$ is the assumed start time (seconds) when all frequency components are assumed in-phase.

This phase correction can be viewed as a multiplication of the complex value with a rotation matrix (M), i.e.

$$q=M*p,$$

where q is the phase corrected complex spectrum (i.e. the Absorption (Ab) and Dispersion (Di) spectrum) for point p of the complex spectrum and M is the said marix; which more specifically can be given by $$\begin{pmatrix} Ab(q) \\ Di(q) \end{pmatrix} = \begin{pmatrix} \cos\varphi & \sin\varphi \\ -\sin\varphi & \cos\varphi \end{pmatrix} \begin{pmatrix} \mathrm{Re}(p) \\ \mathrm{Im}(p) \end{pmatrix}$$

with the phase change by an angle $\phi$, being represented as $$\phi=\phi_0+2\pi f t_0$$

The value of $\phi_0$, as described below, is preferably obtained by finding a value of $\phi_0$ which is independent of the frequency and then refining that found value of $\phi_0$ dependent on the frequency.

For convenience the multiplicity of phase corrections C for the different points of the spectrum is below called "phase correction vector", the multiplicity of spectral data points may be called "data vector", and so on.

Determination of the assumed start time, $t_0$, is described below. It can be seen that since the magnitude correction vector component, Magnitude(f), is 1, the magnitude is unchanged by the phase correction vector of Equation (2) and only the phase is corrected. Herein the Equation (2) above and any other equations comprising phase parameters also encompass the equivalent equation expressed in degrees instead of radians.

The phase correction is obtained after determining $t_0$, the assumed start time of the transient, and hence $\phi_0$. The preferred method of determining $t_0$ and $\phi_0$ is now described.

The transient signal as a function of time (t) from any given frequency component is given by:

$$\text{Transient Signal } (t)=\sin(2\pi\cdot f\cdot t+\phi_0) \qquad \text{Equation (3)}$$

where t is time (seconds);

f is the frequency of the component (seconds$^{-1}$); and $\phi_0$ is the initial phase (radians) at t=0.

An ideal symmetric peak in the Absorption spectrum is obtained when the signal has an initial phase, $\phi_0$, of exactly zero at the start of the transient, i.e. t=0, and so has a zero phase angle at the centre position in the Absorption spectrum. However, due to time delays inherent before acquisition of the transient, real signals typically have a non-zero phase angle at their centre positions. If the initial condition is known it is possible to shift the phase of the Absorption spectrum so that the various signals in the transient are in phase. In the present invention, this is preferably done by determining the assumed start time, $t_0$, when all the signals are assumed in-phase and hence $\phi_0$ can be determined. The phase correction vector of Equation (2) may then be applied to the complex spectrum, i.e. to the real and/or imaginary components of it which contain the phase information.

Determination of the assumed start time, t0, may be conducted by following the sine-shaped transients for multiple components (i.e. multiple ions) backwards from the start of detection (i.e. recording) of the transient, $t_{det}$, until a time, $t_0$, is determined at which the multiple components are assumed to be in-phase ("phase locking"). The method preferably selects multiple points in time preceding $t_{det}$ within a predetermined range, e.g. multiple points in time around an expected value for $t_0$. For each such point in time the method determines the phases of multiple components of the transient and a deviation (i.e. spread) of phases of the multiple components of the transient. The time point where the deviation of the phases is substantially at a minimum is then determined as $t_0$, the assumed start time. From $t_0$ it is possible to calculate $\phi_0$ for each component, i.e. the phase at $t_0$. The phase correction vector may then be established from $t_0$ and $\phi_0$, e.g. according to Equation (2). The values of $t_0$ and $\phi_0$ and hence the phase correction vector may need to be established only periodically and possibly, for example, approximately once per day. However, for greater accuracy and stability, typically $t_0$ and $\phi_0$ and hence the phase correction vector are calculated for each transient or scan.

In view of the above, the present invention provides in a further aspect a method of determining a phase correction for a complex spectrum obtained by Fourier transformation from a detected transient, comprising:

selecting multiple points in time preceding the start of detection of the transient;

determining for each selected point in time a measure of the deviation of phases of selected multiple components of the transient;

determining the point in time, $t_0$, at which the measure of the deviation of phases is substantially at a minimum;

determining the phase, $\phi_0$, of each of multiple components of the transient at $t_0$; and applying a phase correction to the complex spectrum using a function of $t_0$ and $\phi_0$ to obtain a phase corrected complex spectrum.

The method of determining a phase correction according to the further aspect of the invention has been found to be a simple and robust method compared to known methods. The transient is preferably a transient obtained from the oscillation of ions in a mass analyser. The method of determining a phase correction according to the further aspect of the invention has been found to be much faster than methods described in the prior art which state "a few minutes" per spectrum, whereas the present invention may achieve a phase correction determination of more than 1 phase correction per second.

The selected multiple points in time preceding the transient detection, which may be referred to herein as test values, are preferably selected around an expected or a known approximate of the time corresponding to the phase correction or "start time" (e.g. injection time).

The measure of the deviation of the phases can be calculated, for example, by determining the distance between the maxima of the magnitude spectrum and maxima of the real-part of the complex spectrum. When the real part of the spectrum is the absorption spectrum (i.e. in-phase) there is a distance of zero between these maxima. Accordingly, it is possible to calculate a quantity which is a measure of the difference in position between the maxima of the magnitude spectrum and corresponding maxima of the real-part of the complex spectrum for the selected multiple components, e.g. to calculate the sum (for all selected multiple components) of [position(magnitude spectrum)−position(absorption spectrum)]$^2$ and finding the time $t_0$ and phase $\phi_0$ where the sum is substantially at a minimum. For example, in a particular case, the invention provides a method of determining a phase correction for a complex spectrum obtained by Fourier transformation from a detected transient, which comprises: for a plurality of spectral peaks, calculating an Absorption spectrum (i.e. a phase corrected spectrum) for a plurality of test-phases, $\phi$ (as a function of t and f) and summing the distances between peak maxima of a Positive spectrum (i) and the Absorption spectrum (ii) for the plurality of peaks, and selecting the phase $\phi$ for which this sum minimizes for the phase correction. Herein a spectral peak is defined as a local maximum comprising 3 data points above an S/N of 1. Thus, the step of determining for each selected point in time a measure of the deviation of phases of selected multiple components of the transient preferably comprises determining a phase correction value from f and t for each component selected, applying this phase correction to create an absorption spectrum for each component, calculating a distance between the peak maxima of each component as observed in the magnitude spectrum and the peak maxima observed in the absoprtion spectrum, and adding the distances to form the measure.

The method of the further aspect preferably comprises selecting the said multiple components by identifying peaks, e.g. in the frequency/mass domain. Identifying the peaks is preferably performed by calculating a spectrum which comprises a function of the real component and the imaginary component of the complex spectrum and from said calculated spectrum identifying peaks. Preferably, the said spectrum calculated from the complex spectrum comprises a Positive spectrum as herein defined and more preferably comprises the magnitude spectrum or power spectrum, as those spectra are herein described. More preferably still, the said spectrum calculated from the complex spectrum comprises the magnitude spectrum. For a multiple of the identified peaks, i.e. multiple components of the transient, the method may then determine for each selected point in time (i.e. test points) the aforesaid deviation of phases of the peaks/components. In preferred embodiments, a plurality of abundant peaks, more preferably the most abundant peaks are chosen as the multiple components with which the method of the further aspect may be performed. It is also highly preferable to choose components which collectively cover a wide frequency range. For example, the method may comprise considering different frequency ranges and selecting the most abundant peaks within each frequency range as the chosen multiple components. In more preferred embodiments still, the selection criteria for the multiple components to be used for the determination of $t_0$ is that the most abundant peaks are chosen subject to one or more, preferably all, of the following further criteria: rejection of those peaks which are on a list of known "noise" peaks; rejection of those peaks with unacceptable shape and/or width (i.e. reject peaks that are narrower or wider than expected or, e.g., have a shoulder); rejection of those peaks which do not have a S/N above a certain threshold; selected peaks are picked from across the spectrum, to give good coverage of all regions. Furthermore, a two step or iterative method may be used wherein, after a first round of measuring the deviation of phases, all peaks with sufficiently high phase deviations are eliminated and only the "better" ones are used for calculation of the exact spectral phase correction.

Herein, the description describes in relation to numerous aspects that spectral features or "peaks" are identified in the data, e.g. by simple thresholding or by more advanced methods, e.g. as disclosed in U.S. Pat. No. 7,657,387. Additionally, for some aspects of the invention, especially for determining an interpolated position of such "peak" it is necessary that a peak comprises at least 3 consecutive points, where the highest point is not at the edges. However, it is to be understood that the invention may be applied to a limited number of spectral features only, as well as to complete spectra and determination of peaks or interpolated peak positions is not necessary. The invention may work sufficiently well without any peak selection whatsoever or with just determination of local or global maxima or with a list of top intensity points in the spectrum.

Preferably, the method comprises calculating $\phi_0$, the phase at $t_0$, for the multiple components of the transient. Preferably, the phase correction is applied to the complex spectrum by multiplying each point in the complex spectrum by a point from a phase correction vector which is a function of $t_0$ and $\phi_0$, to obtain the phase corrected complex spectrum. More preferably, the phase correction vector which is a function of $t_0$ and $\phi_0$ is the phase correction vector substantially according to Equation (2). In other words, the Absorption spectrum is preferably obtained after a phase correction is applied to the complex spectrum by multiplying it's data points by the corresponding values of a phase correction vector which is a function of the assumed start time when all components of the transient are assumed to be in phase ($t_0$) and the phase at the assumed start time ($\phi_0$). The method of applying the phase correction is thus preferably an element-by-element multiplication of the vector.

The further aspect of the invention is applicable to the other aspects of the invention. The further aspect of the invention is preferably applied to a complex spectrum obtained by causing ions to oscillate in a mass analyser, obtaining a transient from the oscillation of the ions and Fourier transforming the transient to obtain the complex spectrum, preferably as described herein. The phase corrected spectrum obtained according to the further aspect of the invention may advantageously be employed to provide spectrum (ii) which comprises the real or imaginary component of the complex spectrum after a phase correction has been applied to it.

It is observed that even at $t_0$, although the deviation in phases of the multiple transient components is at a minimum and close to zero it is in fact in practice not typically zero, i.e. there is a residual phase deviation or phase dispersion. An additional step, therefore, herein termed a phase dispersion calibration, is preferably employed for correcting the phase which is designed to compensate for this so-called phase dispersion, i.e. to compensate for the typical observed non-zero deviation in phases of the multiple transient components at $t_0$. The said phase dispersion calibration preferably comprises measuring the deviation in phases of the multiple transient components at $t_0$ and adjusting the phases based on said measurement, e.g. by a frequency (or m/z) dependent function. For example, the phases may be adjusted by adjusting the calculated value of $\phi_0$ by an amount based on said measurement of phase deviation at $t_0$. The adjusted value of $\phi_0$ obtained by the phase dispersion calibration can then be used in the phase correction vector. Accordingly, the adjusted values of $\phi_0$ become a function of the data points (e.g. frequency).

It will be appreciated that the phase correction may be determined from one spectrum (i.e. as a source of calibration) and subsequently applied to one or more other spectra.

The spectra (i) and (ii) are the input spectra for calculating the enhanced spectrum. The enhanced spectrum preferably comprises a weighted sum of (i) and (ii). The enhanced spectrum, ES(p), more preferably comprises, or even more preferably consists essentially of, the function:

$$ES(p)=A(p)\cdot Sii(p)+B(p)\cdot Si(p)$$

where ES(p) is the enhanced spectrum at point p; A(p) is the weighting of spectrum (ii) at point p; Sii(p) is the spectrum (ii) at point p; B(p) is the weighting of spectrum (i) at point p; Si(p) is the spectrum (i) at point p; and point p may be a point in the frequency, for mass (m/z) domain or other related domain of the complex spectrum. It will be appreciated that the enhanced spectrum may include further factors in addition to the function above, e.g. it may comprise one or more further factors added to the function above, or may comprise one or more further factors multiplying the function above etc. More preferably and simply, the enhanced spectrum is given by the function above.

The enhanced spectrum is preferably calculated point by point, with each point being calculated from the two input points of the respective two input spectra, spectrum (i) and spectrum (ii). The weighting of spectrum (i) and spectrum (ii) in their summation to obtain the enhanced spectrum may be the same for all points in the enhanced spectrum or different for different points, e.g. different for each point. Preferably, the enhanced spectrum is calculated point by point and the weighting is determined point by point across the enhanced spectrum. More preferably, the enhanced spectrum is calculated by using a weighting for summing spectrum (i) and spectrum (ii) which emphasises the spectrum (i) near to peak edges or base (i.e. where spectrum (ii) may have sidelobes) and emphasises spectrum (ii) near to the peak centre or apex (i.e. where the superior resolution of spectrum (ii) can be utilised). In order to assist this, preferably the enhanced spectrum is calculated point by point wherein for each point being calculated a plurality of neighbouring points are considered in order to determine the position of the point being calculated relative to a peak position (e.g. whether the point is positioned near to a peak centre or peak edge). For example, 10 to 50 neighbouring points may be considered. The weighting of spectrum (i) and (ii) in their summation to form the enhanced spectrum may comprise applying a simple multiplication factor to one or both spectrum (i) and (ii) or the weighting may comprise applying some other function to one or both spectrum (i) and (ii) prior to their summation.

The enhanced spectrum preferably comprises a weighted sum of spectrum (i) and spectrum (ii). In some embodiments, the enhanced spectrum may further comprise said weighted sum and additionally one or more other factors. Such one or more other factors may be added to, subtracted from, multiplied with and/or divided into the said weighted sum or otherwise applied to said weighted sum by mathematical function.

Any residual sidelobes may be further corrected by applying a function of points in spectrum (ii) calculated by a finite-impulse-response (FIR) filtering type method. FIR filtering is described in signal processing textbooks such as Lyons R. G. (ed.), *Understanding Digital Signal processing* (*Prentice Hall*), 2004 (see Chapter 5 therein). The calculation of the enhanced spectrum therefore preferably further comprises applying a correction, e.g. by applying corrections derived in a type of FIR filtering, to each point of the enhanced spectrum. In more detail, any residual sidelobes may be further corrected by applying one or multiple corrections to each point of the enhanced spectrum. These one or more corrections are preferably calculated by using finite-impulse-response (FIR) filtering. A first correction is preferably a FIR-filtered absorption spectrum. A second additional correction is preferably a FIR-filtered version of the absolute values of the absorption spectrum.

Similarly a further improved spectrum may be obtained by replacement of each data point by a weighted sum of the corresponding point in the magnitude spectrum, the absorption spectrum and at least one neighbouring point in the magnitude and/or absorption spectrum. The individual weights of the data used for the new data point are preferably different and may be negative. Preferably the number of neighbouring points used is approximately equal to the width of the instrument function (i.e. the Fourier transformed apodisation function) expressed in points. The apodisation function is preferably selected such that the instrument function only has significant values for a limited number of points, that is the resulting peak shape is such that the spectral leakage of a peak is limited to a small number of data points. One such function is the Hann function. Other examples of such windows are the Blackman and Connes Functions.

The enhanced spectrum is a mass spectrum. The term mass spectrum herein means a spectrum in the m/z domain or spectrum in a domain directly related to the m/z domain such as the frequency domain. The term mass also refers generally to m/z, frequency or any other quantity directly related to m/z and vice versa (e.g. the term frequency refers also to mass etc.). Incidentally, the terms mass and m/z are herein used interchangeably and accordingly a reference to one includes a reference to the other.

It will be understood that the mass ranges of the complex spectrum, spectrum (i), spectrum (ii) or enhanced spectrum, e.g. ranges in the frequency or m/z domains, may be selected to cover the range of the mass spectrum which it is desired to analyse. Accordingly, the enhanced spectrum may cover a wide or narrow mass range. The mass range of the enhanced spectrum may be the same as for conventional mass spectra obtained from a FT mass analyser. Herein mass range means the range in the m/z domain or in a domain directly related to the m/z domain such as the frequency domain.

In order to improve the mass accuracy of the mass spectrum i.e. the enhanced spectrum, it has been found that the mass accuracy is frequently better for the spectrum (i) than the enhanced spectrum owing to the sensitivity of the peak position to small errors in phase correction, as outlined in the "background" section above. Accordingly, and preferably, the mass label or centroid value assigned to a peak in the enhanced spectrum is the mass label or centroid value calculated for the corresponding peak in the spectrum (i) except where a peak in the enhanced spectrum does not have an unambiguous corresponding peak in the spectrum (i) (e.g. because the enhanced spectrum has resolved peaks which the spectrum (i) has not) where the mass label or centroid value assigned to the peak in the enhanced spectrum is the mass label or centroid value calculated for the peak in the enhanced spectrum.

The method preferably further comprises outputting data representative of the enhanced spectrum. Correspondingly, the apparatus preferably further comprises an outputting device for outputting data representative of the enhanced spectrum. The outputting device may comprise an electronic display device (e.g. VDU screen) or printer, the outputting device preferably being under the control of an information processor, e.g. computer, which may be the same information processor, e.g. computer, used to perform the transformations and calculations to obtain the enhanced spectrum but is typically a different information processor which is used for data evaluation and/or display. The enhanced spectrum is typically calculated "on the fly" by an information processor which is built into the apparatus.

The frequency domain enhanced resolution spectrum may be converted to a mass spectrum by converting frequency values into mass values using known equations in a conventional manner.

Herein the term mass spectrum (and equivalent terms such as mass spectra) refers to a spectrum in the m/z domain and also any spectrum in a domain which can be derived from the m/z domain, such as the frequency domain for example.

DETAILED DESCRIPTION OF THE INVENTION

In order to more fully understand the invention, it will now be described in more detail with reference to the accompanying Figures in which.

Figure 1A:
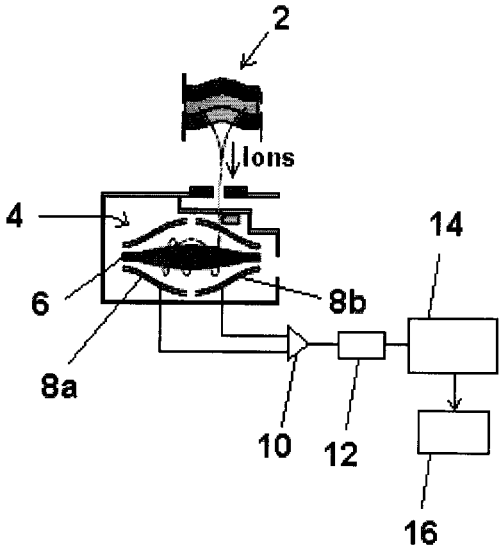
FIG. 1A shows schematically part of an apparatus according to the present invention.

Referring to FIG. 1A, an apparatus according to the present invention is shown which is part of a mass spectrometer and comprises an ion injection device 2 and a mass analyser 4. The ion injection device 2 in this case is a curved linear trap (C-trap) and the mass analyser 4 is an Orbitrap™ electrostatic orbital trapping mass analyser. The apparatus is schematically shown in longitudinal section view. The C-trap may receive and trap ions from an ion source (not shown but which may be any known type of source such as ESI, MALDI, CI, EI etc.), optionally after one or more stages of processing such as mass filtering, ion fragmentation etc. Other parts of the mass spectrometer which are not shown are conventional, such as an ion source, additional ion optics, vacuum pumping system, power supplies etc. The Orbitrap™ mass analyser 4 comprises a central spindle shaped electrode 6 and a surrounding outer electrode which is separated into two halves 8*a* and 8*b*. The annular space between electrode 6 and electrode halves 8*a* and 8*b* is the volume in which the ions oscillate and the electrodes are shaped and electrically biased to form a hyper-logarithmic electric field in the annular space. The midpoint between the two outer electrodes 8*a* and 8*b* is referred to as the equator of the Orbitrap™ mass analyser. Ions having different m/z values which are trapped within the C-trap are injected from the C-trap into the Orbitrap™ mass analyser in a short packet at an axial position which is offset from the equator of the analyser in order to achieve "excitation by injection" whereby the ion packet immediately commences oscillation within the mass analyser in the hyper-logarithmic field. In the Orbitrap™ mass analyser, the ions oscillate axially between the two outer electrodes 8*a* and 8*b* whilst orbiting around the inner electrode 6. The axial oscillation frequency of an ion is dependent on the m/z value of the ion so that ions in the packet with different m/z begin to oscillate at different frequencies. The ion packet therefore soon becomes axially spread out.

The two outer electrodes 8*a* and 8*b* serve as detection electrodes. The oscillation of the ions in the mass analyser causes an image charge to be induced in the electrodes 8*a* and 8*b* and the resulting image current in the connected circuitry is picked-up as a signal and amplified by an amplifier 10 connected to the two outer electrodes 8*a* and 8*b* which is then digitized by a digitizer 12 and the digitized signal, i.e. the transient, is then received by an information processor 14 and stored in memory. The memory may be part of the information processor 14 or separate, preferably part of the information processor 14. The information processor 14 in this case is a computer running a program having elements of program code designed for processing the transient according to the present invention and the steps described herein. The computer 14 is connected to output means 16, which can comprise one or more of: an output VDU, printer, data writer or the like.

Figure 1B:
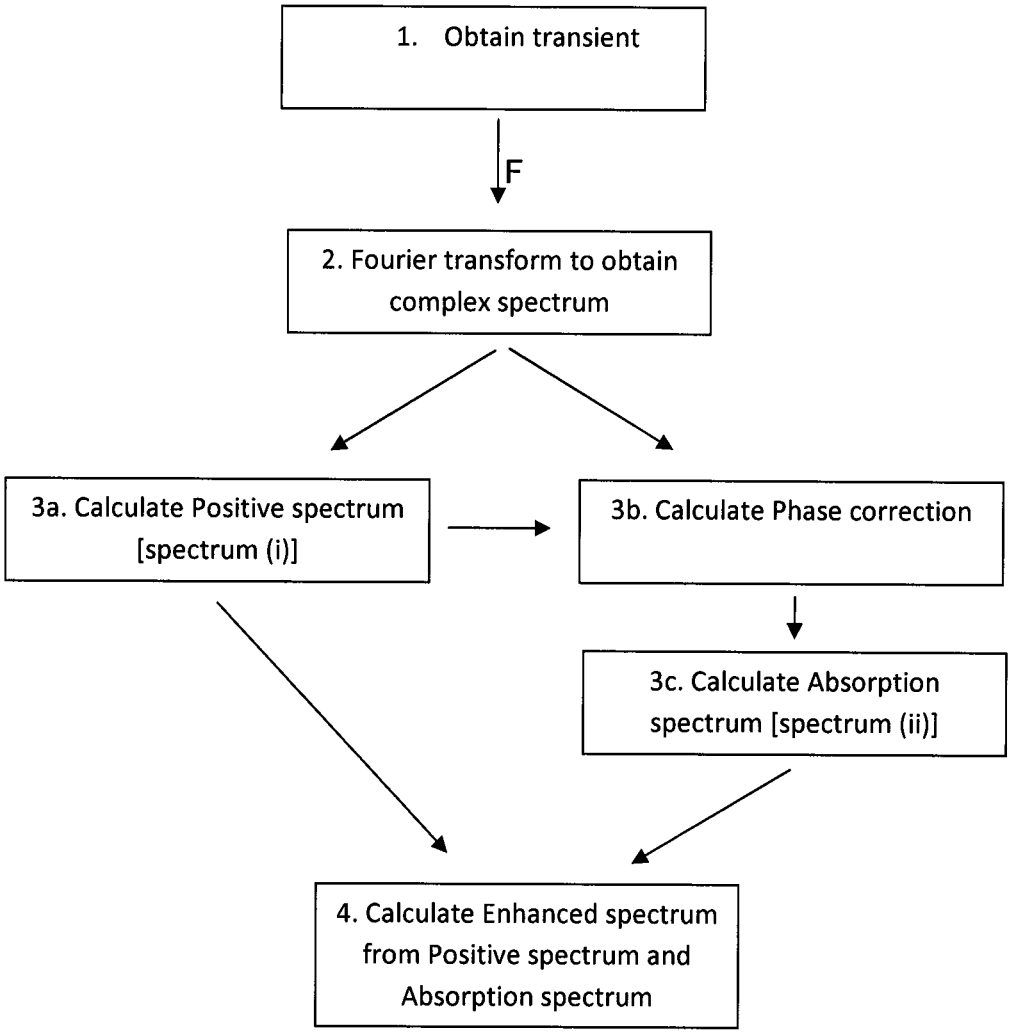
FIG. 1B shows a schematic flow diagram of an example of a method according to the present invention.
Figure 2A:
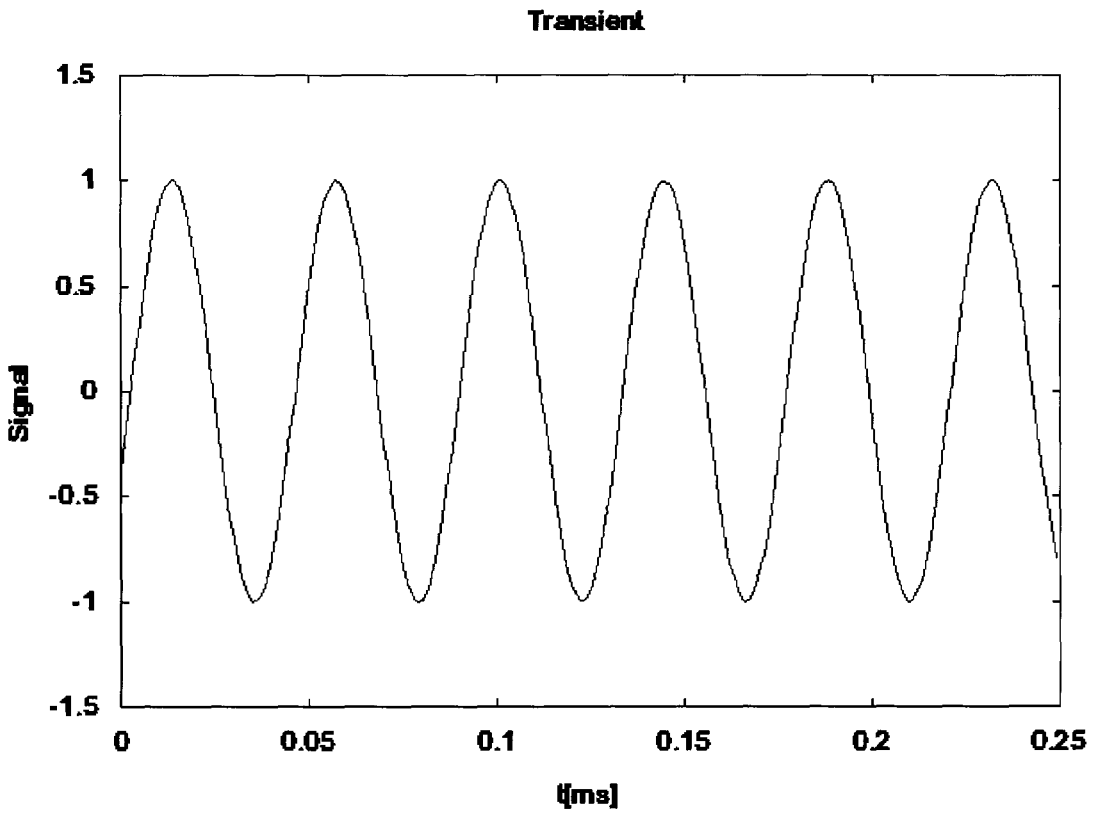
FIG. 2A shows an "ideal" transient for just a few oscillations of a single frequency (m/z) component.
Figure 2B:
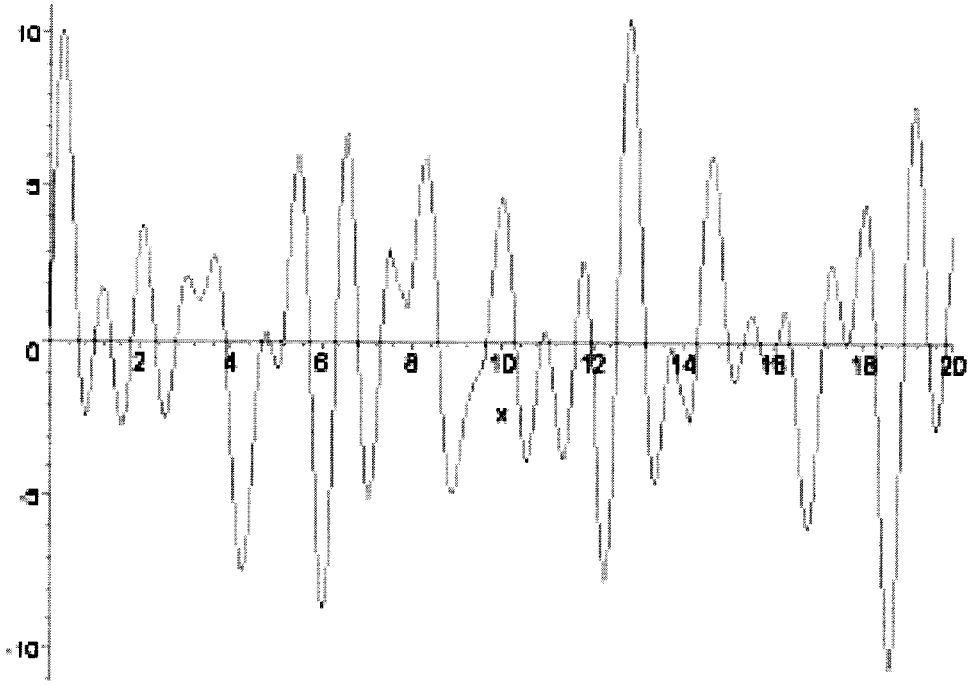
FIG. 2B shows a transient for just a few oscillations of a limited number of frequency (m/z) components.

Obtaining the transient is step 1 in the flow diagram of a method according the present invention shown in FIG. 1B. The transient received by the information processor 14 represents the mixture of the image currents produced by the ions of different m/z values which oscillate at different frequencies in the mass analyser. A transient signal for ions of one m/z is basically sine-shaped as shown in FIG. 2A, which shows a "symbolic" transient for just a few oscillations of a single frequency (m/z) component. A representative transient obtained when several different frequencies are combined is shown in FIG. 2B. The m/z value of the ion determines the period (and frequency) of the sine-shaped function. The Signal for single frequency component is given by $$\text{Single transient Signal}=\sin(2\pi\cdot f\cdot t+\phi_0),$$

where f is the frequency, t is time and $\phi_0$ is the initial phase (at t=0).

Figure 3:
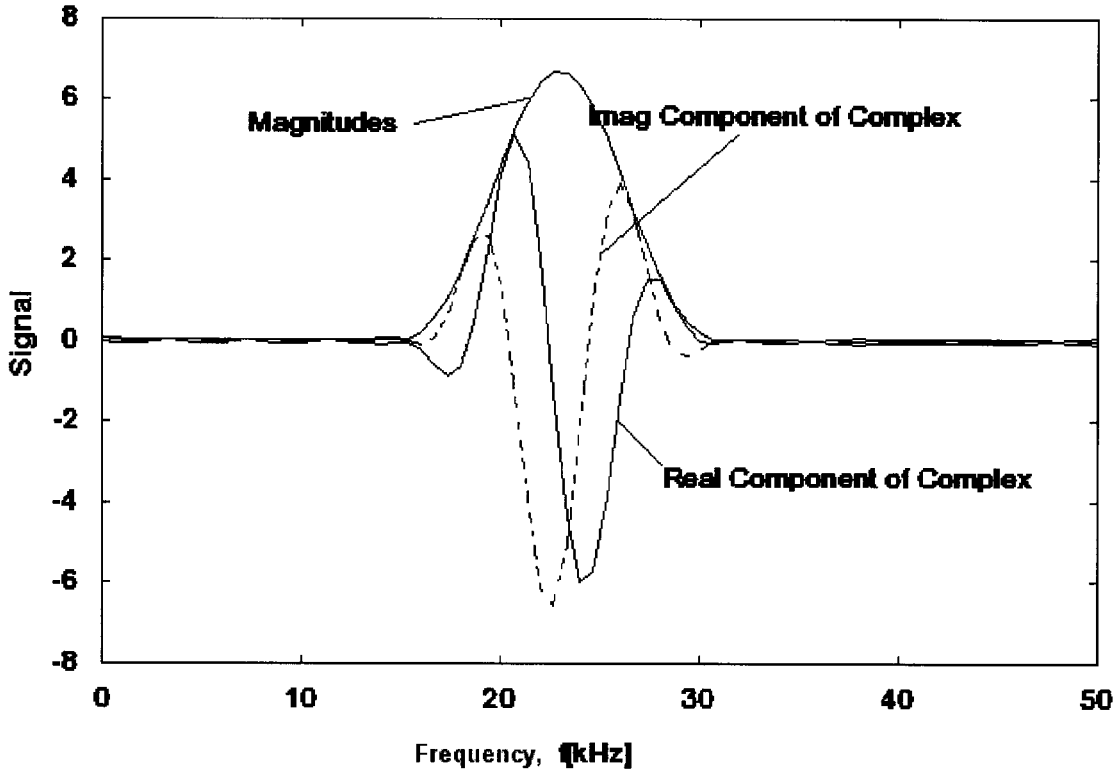
FIG. 3 shows the Fourier transformation of the ideal single frequency signal shown in FIG. 2A together with the magnitude mode spectrum.

The information processor 14 performs a Fourier transformation on the received transient. The Fourier transformation is step 2 in the flow diagram of a method according the present invention shown in FIG. 1B. The mathematical method of Fourier transformation is used to convert the transient in the time domain, which comprises the mixture of basically sine-shaped transient signals which result from the mixture of m/z present among the measured ions, into a spectrum in the frequency domain. If desired, at this stage or later, the frequency domain can be converted into the m/z domain by straightforward calculation. The Fourier transformation produces a spectrum which has a profile point for each frequency or m/z value, and these profile points form a peak at those frequency or m/z positions where an ion signal is detected (i.e. where an ion of corresponding m/z is present in the analyser). Mathematically, the Fourier transform outputs two values for each profile point: a magnitude and a phase angle (often simply termed phase) which are represented by a complex number, i.e. having a real component, Re, and an imaginary component, Im. The real component, Re, and imaginary component, Im, thus constitute a so-called complex spectrum. FIG. 3 shows the real component, Re, and imaginary component, Im, for the Fourier transformation of the ideal single frequency signal shown in FIG. 2.

It can be seen that the real component and imaginary component are asymmetrical because the initial phase of the signal at the start of the transient as shown in FIG. 2 is not zero. Since asymmetrical peaks are undesirable, this has lead in the prior art to the use of the so-called magnitude spectrum rather than a spectrum based on the real or imaginary components alone. Therefore, conventionally, in today's FTMS instruments, the phase angle information is ignored due to the component signals not being in phase at the start of the detected transient and only the magnitude information is used for forming the spectrum profile showing the peaks, i.e. the magnitude spectrum, where magnitude=$[Re^2+Im^2]^{1/2}$. However, the magnitude spectrum is of lower resolution than the so-called absorption spectrum which is obtained from the real component, Re, of a phase-corrected spectrum and which contains phase information. FIG. 3 also shows the magnitude curve derived from the real and imaginary components which forms a peak at a specific frequency. The m/z value of the ions can be derived from the frequency of the peak's centre. The symmetry of the magnitude peak is evident but so too is its greater peak width (lower resolution) compared to the Re and Im components.

It is known that the resolution of the spectrum could be improved if the phase information could be used instead of just ignoring it. In order to get a resolution-enhanced profile spectrum, there has been proposed the approach of using a component of the complex spectrum (e.g. the "absorption spectrum", which is the real component of the complex spectrum or the "dispersion spectrum", which is the imaginary component of the complex spectrum). However, absorption spectra with properly centred symmetric peaks are obtained only for pure signals with an initial phase of exactly zero at the start of the transient since the transient signal (in arbitrary units) is given by Equation (3) above, i.e.

$$\text{Transient Signal } (t)=\sin(2\pi\cdot f\cdot t+\phi_0)$$

However, real signals usually have non-zero phase angles at their centre positions, as shown in FIG. 3.

There are at least two major problems to be faced when attempting to deal with this phase problem. Firstly, one has to know the exact starting conditions of the ions (i.e. the "initial phase", $\phi_0$) so that the predicted start position of the sine-shaped transient is known for each m/z value. If the initial phase is known, one can shift the phase of the spectrum, which can be achieved mathematically by known operation, e.g. multiplying each point in the complex spectrum with the corresponding value in a complex phase correction vector. In FT-ICR, these starting conditions are given by the ion excitation process, and there are publications demonstrating that the phase can be predicted for FT-ICR and used for improving the resolution. In the case of the Orbitrap™ mass analyser, the starting conditions are given by the injection of ions into the mass analyser (e.g. from the C-Trap). The more accurately and precisely the starting conditions are known, the better the improvement in the resolution and the accuracy in the profile spectrum which may be achieved. Secondly, even when the starting conditions are known, there is still no known straightforward way of creating a "clean" profile spectrum from the magnitude and phase data that come out of the Fourier transform, i.e. a profile spectrum without artefacts such as sidelobes.

With regard to the first problem above, the starting conditions of the ions may not easily be determined to a high degree of accuracy. For example, in an Orbitrap™ mass analyser, the starting conditions are known but typically with accuracy in the microsecond-range and there are some effects that disturb the effectively observed phase, whereas ideally the required accuracy for the starting conditions is in the range of 10-100 nanoseconds. As a consequence the present invention preferably comprises a means of initial phase determination or phase correction wherein the parameters for predicting the starting conditions are adjusted for each single scan. It is also preferable, for the transient recording to begin with minimal delay, e.g. the Orbitrap™ mass analyser transient recording preferably needs to start close to the moment when the ions are being injected, whereas conventionally one would typically wait a few milliseconds if phases were ignored. Typically, the transient recording should begin within a time from injection which is of the order of a typical peak cycle time, e.g. 2 μs for 500 kHz frequency peak, so preferably within a few microseconds. The invention therefore preferably comprises, especially in the case of the Orbitrap™ mass analyser and like analysers, acquiring the transient with the shortest possible time delay from an ion injection trigger signal, i.e. a signal generated simultaneously with ion injection into the mass analyser. In principle, it is also possible to extrapolate the measured signals back to the point $t_0$. However, the additional processing and algorithmic requirements may be substantial so that a hardware solution is typically preferable.

In preferred embodiments, one or both of the following steps are also performed on the transient prior to the Fourier transform being performed on it, more preferably both of the following steps being performed: windowing the transient with one or more suitable window or apodisation functions, preferably with a Hamming or Hanning (Hann) window, more preferably a Hanning (Hann) window but other window types could be used (e.g. Blackman or Connes); and/or zero-filling to increase the original transient size (e.g. quadruple the size but it could also be increased in size by a different value).

The Fourier transformation is then performed on the transient data to obtain the complex spectrum containing real (Re) and imaginary (Im) components, the complex spectrum being preferably retained by the computer. A spectrum (i) which comprises a function of the real component and the imaginary component of the complex spectrum, e.g. the magnitude or power spectrum, can then be calculated. A phase correction can be applied to the complex spectrum to obtain a spectrum (ii). The spectra (i) and (ii) can then be used to produce the enhanced spectrum according to the present invention as described in more detail below.

Various methods of determining and applying the phase correction may be used to derive the spectrum (ii) for use in calculating the enhanced spectrum according to the present invention, including those methods described in the prior art. However, the preferred method of determining the phase correction, which forms a further aspect of the present invention, is now described in detail.

Figure 17:
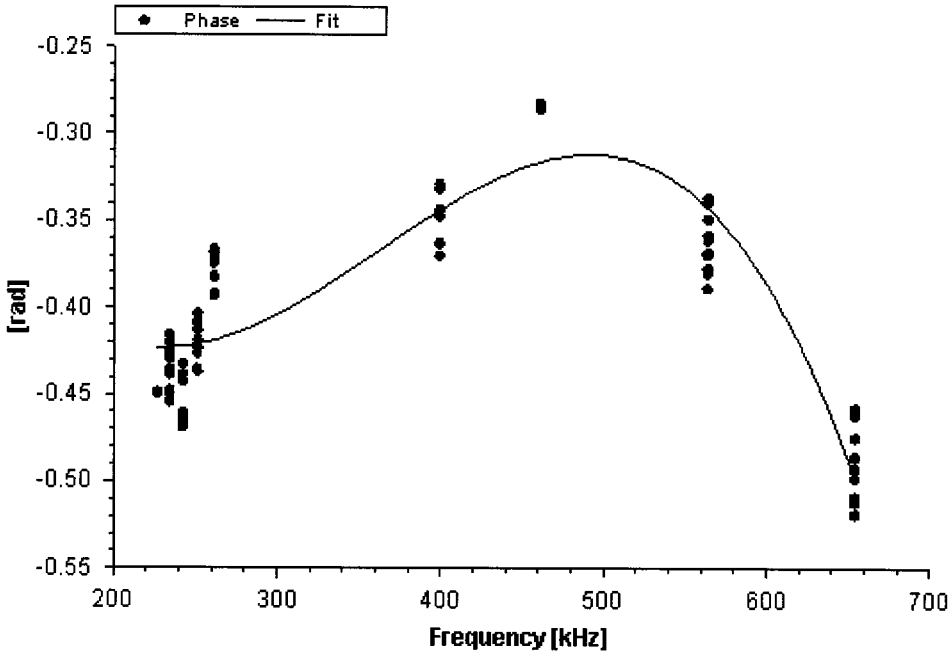
FIG. 17 shows a plot of the phases for selected peaks (frequencies)

On the complex spectrum resulting from the Fourier transform a processing is performed to obtain the peaks in the spectrum and their positions. Preferably, this processing comprises calculating the Positive spectrum (i), e.g. magnitude spectrum or the power spectrum or an estimation of either of the foregoing, but most preferably the magnitude spectrum, i.e. Magnitude(p) =$[Re(p)^2+Im(p)^2]^{1/2}$. Calculating a Positive spectrum represents step 3*a* in the flow diagram of a method according the present invention shown in FIG. 1B. Preferably, such a spectrum is used as spectrum (i) in the determination of the enhanced spectrum. From such a spectrum the peaks and their positions can be identified and at least some of the peaks, preferably the most abundant peaks, are selected for determination of the phase correction as explained in the following description. Calculating the phase correction represents step 3*b* in the flow diagram of a method according the present invention shown in FIG. 1B. Typically, in the range of 3 to 30 abundant peaks are selected, the selected peaks desirably being positioned at distinct frequency positions of the spectrum. In preferred embodiments, the selection criteria for the multiple components to be used for the determination of $t_0$ is that the most abundant peaks are chosen subject to one or more, preferably all, of the following further criteria: rejection of those peaks which are on a list of known "noise" peaks; rejection of those peaks with unacceptable shape and/or width (i.e. reject peaks that are narrower or wider than expected or, e.g., have a shoulder); rejection of those peaks which do not have a S/N above a certain threshold; selected peaks are picked from across the spectrum, to give good coverage of all regions. Furthermore, a two step or iterative method may be used wherein, after a first round of measuring the deviation of phases, all peaks with sufficiently high phase deviations are eliminated and only the "better" ones are used for calculation of the exact spectral phase correction. Selection of the peaks is performed preferably by selecting peaks above a pre-determined intensity threshold, e.g. above a pre-determined noise threshold. More preferably, in selecting the most abundant peaks, an intensity threshold is applied such that in each of a number of frequency positions of the spectrum, the most abundant peaks are selected in each frequency position. For example the 1 or 2 or more most abundant peaks are selected in each frequency position. The number of frequency positions used for this purpose is preferably at least 2, more preferably at least 5, for example in the range of 3 to 5, or 3 to 10, or 5 to 15, or 5 to 10 but may be up to several hundred different positions. As described below, 12 different frequency positions are shown being used in FIGS. 6, and 9 different frequency positions are shown being used in FIG. 17. More preferably, at least 5 different frequency positions is sufficient (e.g. those at f=650, 550, 480, 400 kHz+one of the low frequencies around 200 kHz). The chosen different frequency positions are preferably evenly spaced over the frequency range. The number of different frequency positions depends on the distribution of phase variation over the spectrum. A linear correction can be applied taking two frequency positions, but more complicated phase distributions like that of FIG. 6 may require 5 or more positions to be used. Each selected peak thus corresponds to a selected component of the transient. The centroid of the peak is preferably used as the frequency (m/z). The centroid is the interpolated position of the peak's apex. The centroid position is preferably obtained by calculating a parabola from three spectral points, being the locally highest point and its two neighbours. The vortex of this parabola is the centroid. However, other common centroiding methods, e.g. fitting a Gaussian function etc., may be used.

Figure 4:
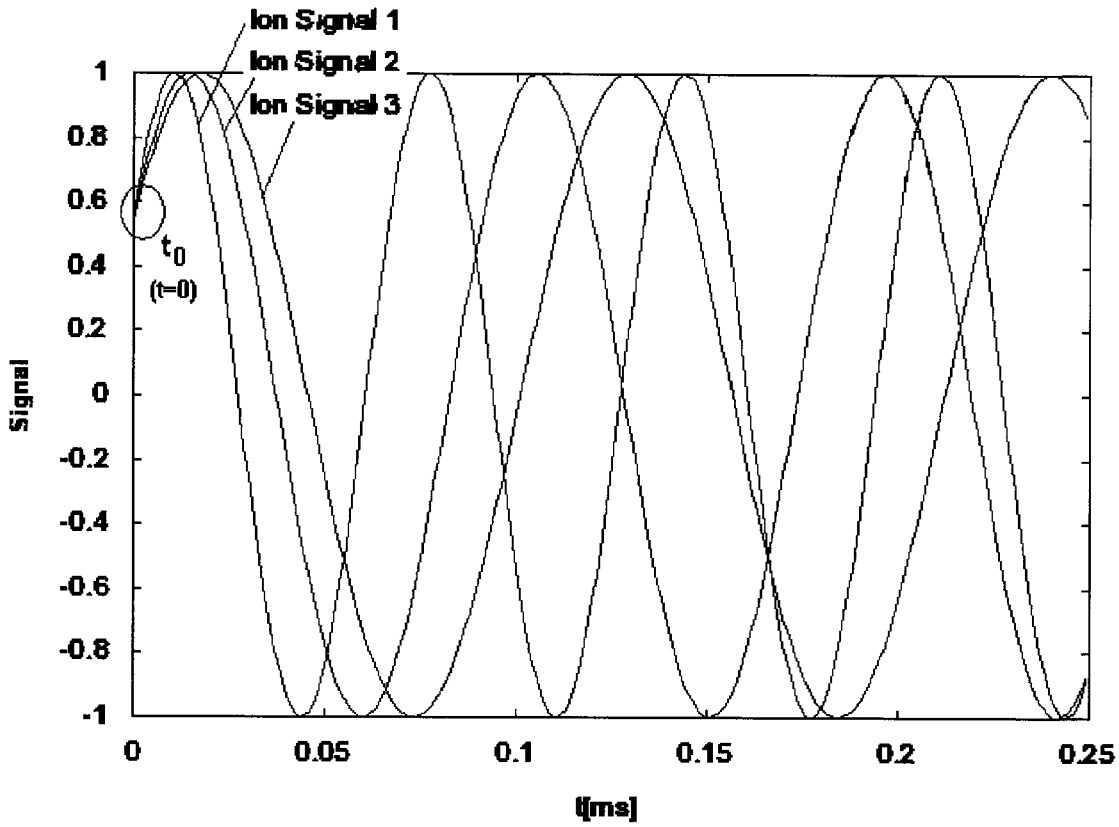
FIG. 4 shows a plot of several individual transient components and their phase coincidence at $t_0$.

As mentioned above, the next task becomes determining the phase correction vector (i.e. comprising a function related to the delay time between ion injection and the start of transient recording plus initial phase on injection). In order to calculate the phase-corrected real or imaginary component of the complex spectrum resulting from the Fourier transform, the exact timing of the ion injection and initial phase for each mass (m/z) value (hence frequency value) needs to be known. In the case of an electrostatic trap analyser such as the Orbitrap™ mass analyser, since all of the ions are injected into the mass analyser in one short packet or pulse, the approximate timing of the injection is known. However higher accuracy is required. The injection time and initial phases can be determined by following the ideally sine-shaped transients of multiple ions backwards until the injection event is detected. The injection event is identified as being that point in time when all the phases of the multiple components, i.e. the phases of the sine-shaped transient functions, are as near to identical as possible. FIG. 4 shows simulated transient signals from different ions with different frequencies (different m/z). Due to the nature of the ion injection into the mass analyser, such as an Orbitrap™ mass analyser for example, where ions of all m/z are injected at the same time, there is a time, $t_0$, at the time of injection, at which all transient signals have identical phase. This is caused by the intrinsic property of electrostatic traps to have a square-root dependence of frequency on m/z that matches the time-of-flight spreading of ions during the transfer over effective length L from an external storage device so that additional acquired phase shift $\Delta\phi$ is essentially independent on m/z:

$$\Delta\phi=[L/(2zV/m)^{1/2}]*(zk/m)^{1/2}=(kL^2/2V)^{1/2}$$

wherein V is acceleration voltage and k is a characteristic parameter of the Orbitrap™ field.

For simplicity, the shown signal amplitudes in FIG. 4 are all equal, thus the sine-shaped curves all start at one point for $t_0$ (t=0).

The determination of the phase correction preferably comprises selecting a point in time preceding the start of detection (i.e. recording) of the transient, referred to herein as a test delay time, $t_{test}$; calculating the phase, $\phi_{test}$, at $t_{test}$ for each of the multiple selected peaks, i.e. frequency or m/z components of the transient, which are selected from the spectrum (i) (preferably the magnitude spectrum) as described above as being peaks above a pre-determined intensity threshold; and then determining at $t_{test}$ a deviation (i.e. spread) of the $\phi_{test}$ phases of the multiple selected peaks (components of the transient). The $\phi_{est}$ can be calculated from the equation:

$$\phi_{test}=\phi_{peak}-2\pi f\cdot t_{test}$$

wherein $\phi_{peak}$ is the phase at the start of detection (i.e. recording) of the transient which can be calculated using Euler's formula and f is the frequency of the peak/component. Preferably the centroid value of the peak/component is used.

The deviation of the $\phi_{test}$ phases at the given $t_{test}$ can be calculated in various ways, one preferred way being to calculate the average $\phi_{test}$ at the given $t_{test}$ and then determining the sum of the deviations from the average $\phi_{test}$. The minimum in such a sum is then taken as the point in time, $t_0$, the assumed start time when the phase deviation is at a minimum.

The value of ttest is preferably, although not necessarily, a value expected to be within reasonably close proximity to $t_0$, the assumed start time (or injection event) at which the components of the transient are most nearly in-phase. Subsequently, these steps are repeated for a plurality, typically several hundred, of further values of $t_{test}$ in order to obtain a deviation of the phases at each of the values of $t_{test}$. Accordingly, the phase of the selected components is calculated for a pre-determined range of $t_{test}$ values expected to be within reasonably close proximity to $t_0$, the assumed start time (or injection event). Preferably, the further values of $t_{test}$ are each spaced in time from an adjacent $t_{test}$ value by a predetermined fixed step. For an Orbitrap™ mass analyser, typically $t_{test}$ values may be in the range from 0 to 10 milliseconds, e.g. 0 to 2 milliseconds (ms) and the steps between adjacent $t_{test}$ values may be in the range 1 to 1000 nanoseconds (ns), e.g. 100 ns.

Figure 5:
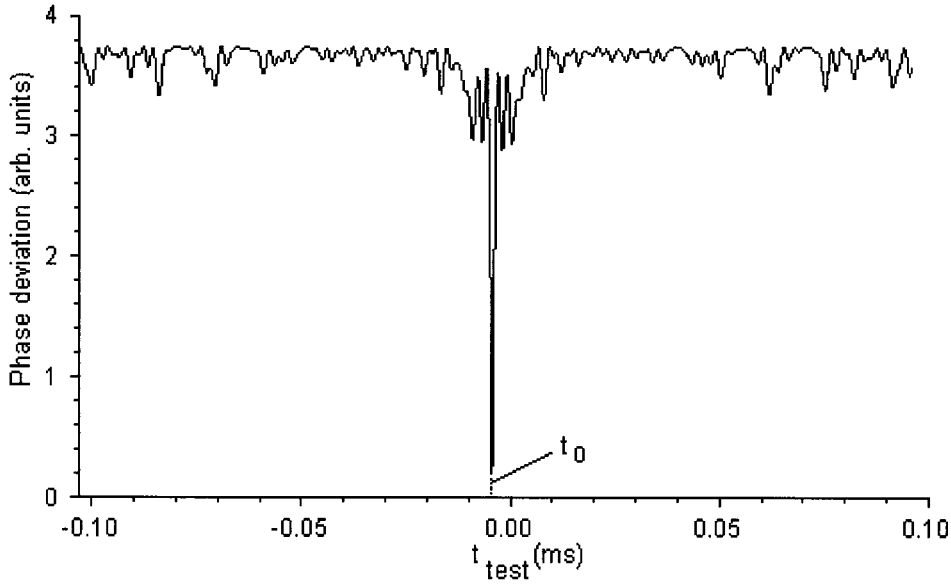
FIG. 5 shows a plot of the deviation of the phases of multiple transient components as a function of delay time, $t_{test}$.

The next step in the method comprises choosing the $t_{test}$ value at which the deviation of the phases is substantially at a minimum, in other words finding the time at which the phases of the multiple components are most closely matched, preferably with close to zero initial phase. This could be done in various ways, one preferred way being to choose the $t_{test}$ value where there is a minimum for the sum of the deviations from the average $\phi_{test}$. The $t_{test}$ value at which the deviation of the phases is substantially at a minimum is taken to be the value of $t_0$, the assumed start time, and $\phi_0$ is the phase at $t_0$. In other words, the algorithm goes through preferably a large number of points in time around the assumed injection time and looks at the spread of the phases for multiple ions at those points in time. The point in time with the lowest spread of the phases is the assumed start time or injection time, $t_0$. FIG. 5 shows a typical plot of the deviation of the phases as a function of $t_{test}$. The minimum deviation, i.e. where the phases are most closely matched, is clearly to be seen and is indicated by the dotted line denoting this point in time as $t_0$. The method of determining a phase correction according to this aspect of the invention, which is run on the computer, has been found to be a reliable method of deriving the starting conditions, $t_0$ and $\phi_0$.

Once $t_0$ and $\phi_0$ are known, a phase correction can be constructed and can then be applied to the complex spectrum using a function of $t_0$ and $\phi_0$ to obtain a phase corrected complex spectrum. For example, a phase correction vector such as Equation (2) above can be used:

$$\text{Magnitude}(f)=1;\ \text{Phase}(f)=\phi_0+2\pi f t_0$$

It will be appreciated that the phase correction may include an additional phase shift of $\pi/2$ radians (90 degrees) so that the peak information effectively becomes shifted from one of the real component and imaginary component to the other. In such a case the phase correction vector such as Equation (2) above would become:

$$\text{Magnitude}(f)=1;\ \text{Phase}(f)=\phi_0+2\pi f t_0+\pi/2$$

As described above, the values of $\phi_0$ and/or $t_0$ are typically functions of the frequency, with there being one phase correction value per data point (e.g. frequency point) in the spectrum.

Accordingly, either the phase corrected real component or the corrected imaginary component may be used to provide spectrum (ii). Preferably, the phase corrected real component is used to provide spectrum (ii).

Figure 6:
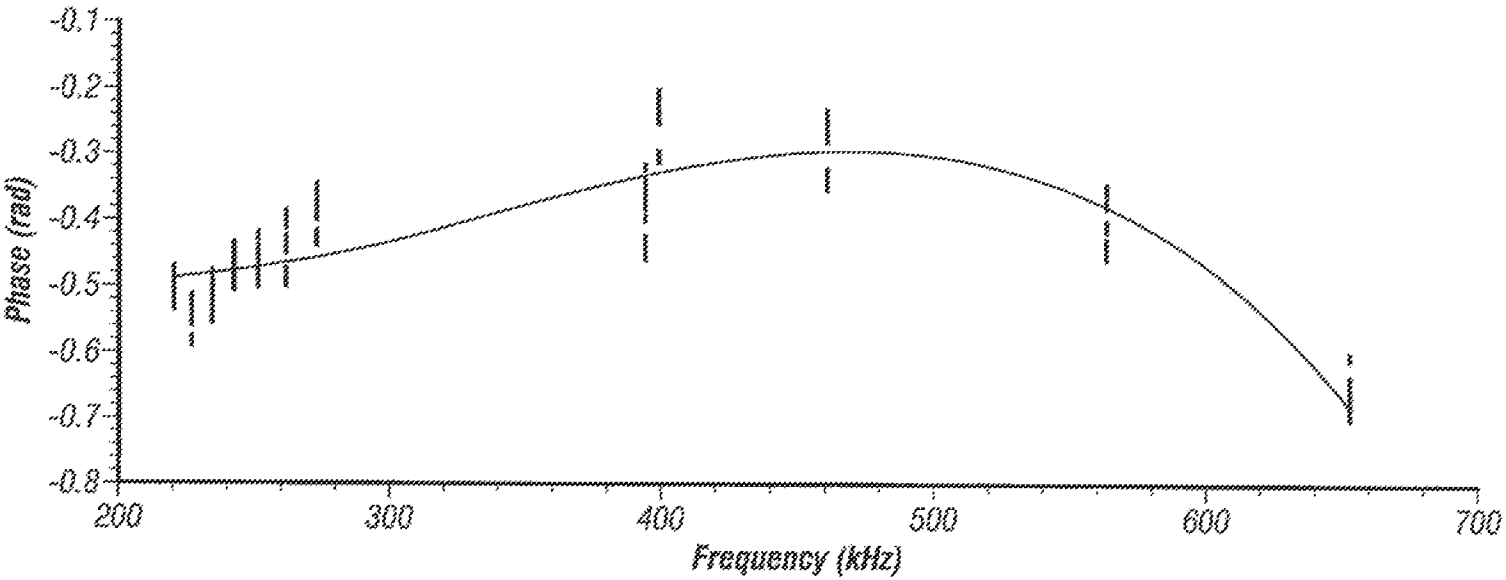
FIG. 6, shows a plot of the phase against frequency for selected frequency components of the complex spectrum.
Figure 7:
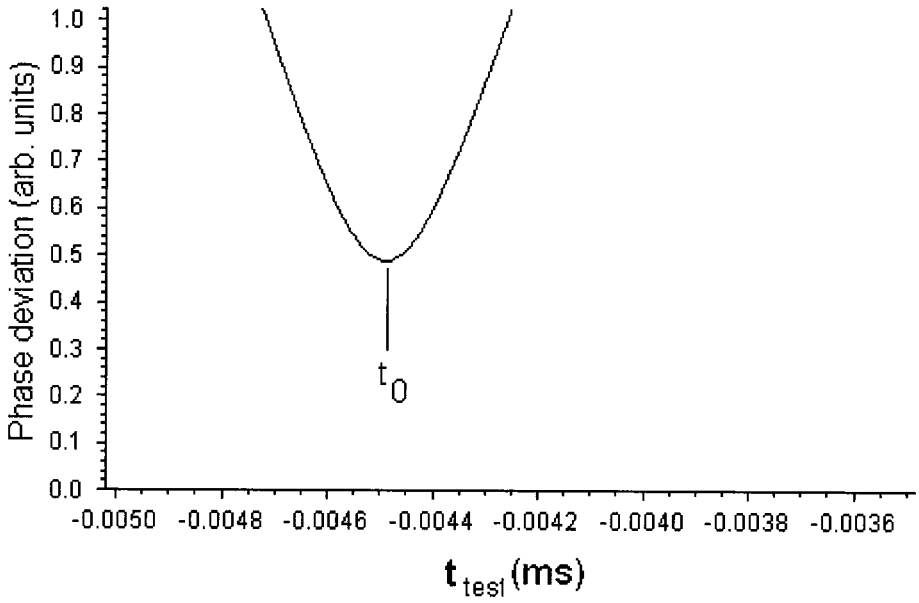
FIG. 7 shows a close-up view of the minimum of the phase deviation plot of FIG. 5, without phase dispersion calibration.
Figure 8:
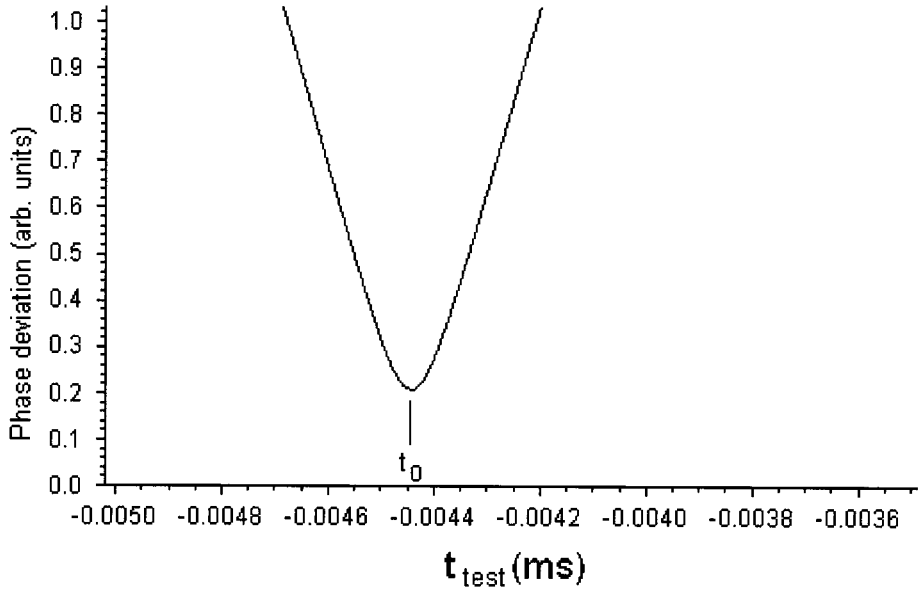
FIG. 8 shows a close up view of the minimum of the phase deviation plot of FIG. 5, with phase dispersion calibration.

Preferably, the phase correction comprises an additional step, referred to herein as phase dispersion calibration. In practice, it can be observed that the calculated deviation or spread of phases at $t_0$ is not exactly zero, as it theoretically would be, but there is some remaining spread of phases. This may be caused by the electronics, ion transfer characteristics, etc. In order to compensate for this, preferably the characteristic of the remaining spread is measured and subtracted from the phases ("phase dispersion calibration"). A preferred method thus comprises applying a phase dispersion calibration to the real and/or imaginary component of the complex spectrum, either before or after phase correction, preferably before so that the minimum in phase deviation described above can be determined after taking account of the phase dispersion calibration. Accordingly, spectrum (ii) preferably comprises a phase dispersion calibration, i.e. is a spectrum after phase dispersion calibration has been applied. In particular, it has been found that the phase shows some frequency (m/z) dependence. Thus, a preferred embodiment for phase dispersion calibration comprises plotting the phase against frequency (m/z) (either before phase correction or after), for one or more transients (scans), and fitting a curve through the plot to obtain a phase dispersion calibration curve. An example of such a plot is shown in FIG. 6, which shows a plot of the phase (rad) against frequency for selected frequency components of the complex spectrum. The multiple points for each frequency are obtained from multiple complex spectra, i.e. after Fourier transformation of multiple transients. It can be seen from FIG. 6 that there is some phase dependence on the frequency and a curve may be fitted, e.g. as shown, to compensate for this dependence. The reason for this dependence could be, for example, variation of acceleration voltage V with time during the pulsed injection into the analyser. The curve may then be subtracted from the phases of the frequency (m/z) components, either before or after the main phase correction. The phase dispersion calibration curve may be comprised in the phase correction vector for example. FIGS. 7 and 8, which have the same scale, show the advantageous effect of the phase dispersion calibration. FIG. 7 shows a close up view of the minimum of the phase deviation plot of FIG. 5, without phase dispersion calibration. FIG. 8 shows the same view with phase dispersion calibration applied. The matching of the phases is clearly much better in the case of applying the phase dispersion calibration as shown by the sharper, deeper valley of the phase deviation minimum.

It is possible that in some cases it may be adequate to determine a phase correction, i.e. $t_0$ and $\phi_0$, only infrequently, e.g. once per day or similar, but a more typical and more accurate mode of operation comprises calculating $t_0$ and $\phi_0$ for each scan (i.e. each transient), although a more limited range of $t_{test}$ close to $t_0$ may be used following establishment of $t_0$ at least once. Such operation is especially effective for scans containing a large number (e.g. hundreds to thousands) of mass peaks with substantial signal-to-noise ratio. Also, this determination could be carried out together with other processing steps, e.g. re-calibration of m/z of peaks. As with mass calibration, additional information could be used, e.g. different charge states of the same analyte (i.e. sets of peaks with very precise ratios between m/z).

Figure 9:
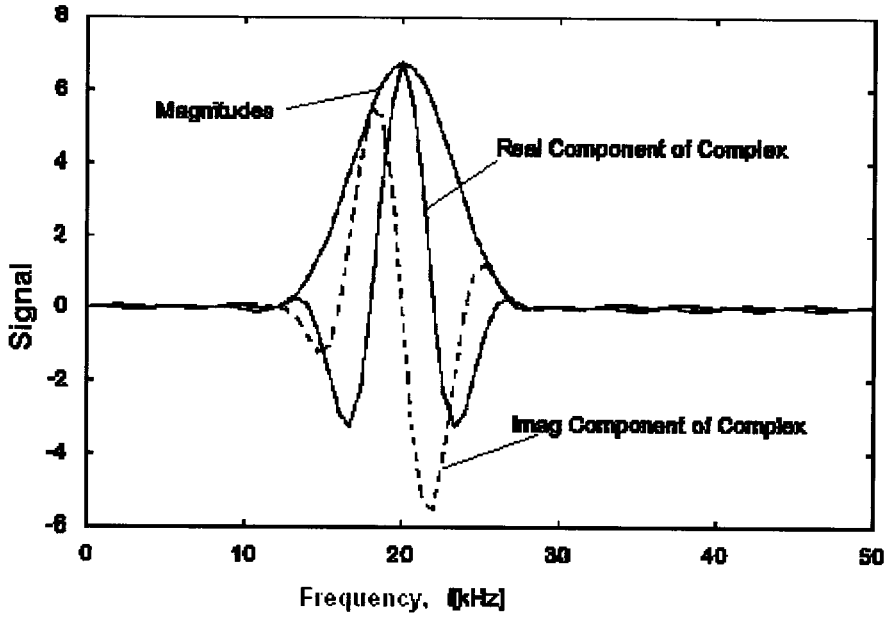
FIG. 9 shows the data of FIG. 3 after phase correction.

After the phase correction has been applied to the complex data it provides substantially symmetrical peaks in the complex spectrum as shown in FIG. 9. FIG. 9 shows the data of FIG. 3 after phase correction. The real component now provides an Absorption spectrum which has a highly symmetrical peak. Calculating the Absorption spectrum represents step 3*c* in the flow diagram of a method according the present invention shown in FIG. 1B. The resolving power or resolution of the absorption spectrum peak, as indicated by the peak width, is clearly much higher compared with the magnitude spectrum peak. The Absorption spectrum can be used as it is, however the Absorption spectrum has a problem of significant negative sidelobes which in certain aspects the present invention seeks to address. The sidelobes may disturb or even hide neighbouring peaks and thus distort the analytical value of the spectrum.

The present invention, in certain aspects, reduces the problem of sidelobes by calculating an enhanced spectrum which results in "cleaner" peaks than the pure Absorption spectrum yet has a similar high resolving power. Calculating the enhanced spectrum represents step 4 in the flow diagram of a method according the present invention shown in FIG. 1B. The enhanced spectrum is calculated by combining the spectrum (i) with spectrum (ii) as defined herein. The calculation of the enhanced spectrum is now described in more detail.

The step of calculating the enhanced spectrum takes a spectrum (i), which comprises a function of the real component and the imaginary component of the complex spectrum and combines it, (preferably sums it), using suitable weighting, with a spectrum (ii) which comprises the Absorption spectrum (i.e. the real or imaginary component of the complex spectrum after the phase correction has been applied to it). The calculation is performed on the computer. The spectrum (i) is preferably the magnitude or power spectrum, especially the magnitude spectrum. The real component and the imaginary component of the complex spectrum, either before or after phase correction, may be used to form the spectrum (i) since the magnitude spectrum and the power spectrum are not changed by the phase correction and are phase-insensitive. The spectrum (ii) preferably comprises the real component of the complex spectrum after the phase correction has been applied to it (the Absorption spectrum), e.g. as described above.

The resultant enhanced spectrum, which can be termed the weighted enhanced spectrum, $ES(p)^{weighted}$, preferably comprises, or more preferably consists essentially of, the function:

$$A(p)\cdot Sii(p)+B(p)\cdot Si(p)$$

where A(p) is the weighting factor of spectrum (ii) at point p; Sii(p) is the spectrum (ii) at point p; B(p) is the weighting factor of spectrum (i) at point p; Si(p) is the spectrum (i) at point p. Points p may be in the frequency f or mass, m/z domains or other related domains. Typically the values of A(p) and B(p) may be in the range from 0 to 1 but may be higher than 1. Preferably, B(p)=[1−A(p)], wherein more preferably A(p) is in the range 0 to 1. The function which the enhanced spectrum comprises then preferably becomes:

$$A(p)\cdot Sii(p)+[1-A(p)]\cdot Si(p)$$

The enhanced spectrum is preferably calculated point by point, e.g. point by point across the frequency (or m/z) domain. In a preferred example, the magnitude spectrum (as spectrum (i)) and the phase corrected real component (as spectrum (ii)) are summed, according to a weighted sum, which results in an enhanced spectrum. Accordingly, in the functions expressed herein relating to the enhanced spectrum, preferably Si(p) is the magnitude spectrum and Sii(p) is the phase corrected real component. The above function thus becomes in the preferred case:

$$A(p)\cdot \mathrm{Re}(p)+[1-A(p)]\cdot \mathrm{Magnitude}(p)$$

where Re(p) is the phase corrected real component (i.e. Absorption spectrum) and Magnitude(p) is the magnitude spectrum.

As another example, the power spectrum and the phase corrected real component (i.e. Absorption) could be summed, according to a weighted sum, which results in another enhanced spectrum. In a further example, the magnitude spectrum and the phase corrected imaginary component could be summed, according to a weighted sum, which results in a further enhanced spectrum. In the latter case, the imaginary component has been phase corrected by an additional π/2 radians (90 degrees) to provide it with the information contained in the Absorption spectrum.

A weighted sum (with weighting A) of (i) and (ii) could, e.g., be directly calculated to good approximation (less than 4% intensity error) in one step:

for points, p, in a peak above 0.5×peak-height:

$$\mathrm{Sum}=(0.96+A)\mathrm{Re}(p)+0.398(1-A)|\mathrm{Im}(p)|.$$

and for points otherwise:

$$\mathrm{Sum}=(0.96-A)|\mathrm{Im}(p)|+0.398(1+A)\mathrm{Im}(p).$$

where Re(p) is the phase corrected real component, Im(p) is the phase corrected imaginary component and |Im(p)| is the absolute value of the phase corrected imaginary component, at a point p.

The algorithm for the enhanced spectrum (the weighting algorithm) preferably includes a weighting that emphasizes the spectrum (ii) (Absorption spectrum component) for regions near a peak top and emphasizes the spectrum (i) (preferably magnitude spectrum) for regions near a peak base where the real (or imaginary) component has significant sidelobes. For example, in the equation above, i.e.

$$A(p)\cdot Sii(p)+[1-A(p)]\cdot Si(p)$$

in the vicinity of a peak, A(p) equals 0 for points near the peak base and 1 for points near the peak top.

The weighting algorithm may emphasize either the spectrum (i) (e.g. magnitude) or the spectrum (ii) (Absorption component) for regions between peaks (i.e. peak-free regions), i.e. regions of low intensity, but preferably the Absorption component for regions between peaks, wherein a zero value is preferably assigned where the Absorption component is negative. In a preferred embodiment, in peak-free spectrum regions the enhanced spectrum comprises the phase corrected real (or imaginary) component (e.g. Absorption spectrum) for points where the spectrum (i), such as the magnitude spectrum, is below a set threshold. The set threshold is preferably of the order of the noise level. Thus, in peak-free regions, preferably the real (or imaginary) component (e.g. Absorption spectrum) is used and not the spectrum (i) (i.e. weighting factor of zero for spectrum (i)) as any sidelobes will be hidden in the noise anyway. This saves significant processing time for calculating the enhanced spectrum.

Additional rules may apply to calculating the enhanced spectrum, for example, special treatments like spectrum clipping may be applied when certain conditions are detected, for example, where the enhanced spectrum is calculated to have a negative value.

Preferably, for each point in the calculation of the enhanced spectrum, the algorithm considers the respective points of the two input spectra (i.e. spectrum (i) and spectrum (ii)), but also a plurality of their neighbouring points on each side (e.g. 5-50 or more preferably 10-50 neighbouring points on each side, i.e. +/−10 points or +/−50 points adjacent the point being calculated) in order to determine whether a point is near a peak top or near a peak base or between peaks. The weighting of the spectrum (i) and the spectrum (ii) for that point may then be chosen accordingly, e.g. to achieve the emphasis described above. The "width" of the calculation, i.e. the number of neighbouring points considered, is preferably matched to the width of the instrument window function and the applied zero-filling (e.g. approx. +/−20 points for the Hann window and threefold zero filling).

In some embodiments, therefore, the weightings of the spectra (i) and (ii) for each point of the enhanced spectrum are determined based on the intensity and position of one or more maxima found within a range of points of spectra (i) and/or (ii) around the point considered.

In some embodiments, the calculation of the enhanced spectrum comprises calculating each point of the enhanced spectrum as a combination (e.g. weighted sum) of spectra (i) and (ii) at the point and one or more neighbouring points, e.g. +/−x neighbouring points surrounding the point (where x is typically approx. 1 to 50, depending on the expected peak shape and it's spectral spread). For example, at a point n, the enhanced spectrum may be calculated as a weighted sum of points from the Magnitude and Absorption spectra at points from n−3, n−2, n−1, n, n+1, n+2, n+3.

The weightings for the spectra (i) and (ii) at individual points of the enhanced spectrum may comprise either positive or negative values.

In view of the foregoing it can be seen that the weighting, e.g. as represented by A(p) and B(p), is preferably calculated for each point, p, of the enhanced spectrum as a function of:

a) The spectrum (i) at that point, $Si_p$;

b) The spectrum (ii) at that point, $Sii_p$;

c) The maximum value of the neighbouring 2 h+1 spectrum (i) points, $Si_p^{max}=\max(Si_{p-h \ldots p+h})$; and d) The maximum value of the neighboring 2 h+1 spectrum (ii) profile points $Sii_p^{max}=\max(Sii_{p-h \ldots p+h})$ The quantity h is the number of neighbouring points considered on either side of the point and may be in the range 5 to 50 or greater, e.g. h=8. In general, h will be of the order of the typical peak profile width. Preferably, the weighting, A(p) is given by:

$$A(p) = 0.5 + 0.5 \cdot \left( \frac{Sii_p}{Sii_p^{max}} \cdot \frac{Si_p}{Si_p^{max}} \right)$$

More preferably, in view of the foregoing it can be seen that the weighting, e.g. as represented by A(p) and B(p), is preferably calculated for each point, p, of the enhanced spectrum as a function of:

a) The magnitude spectrum at that point, $magnitude_p$;

b) The Absorption spectrum at that point, $absorption_p$;

c) The maximum value of the neighbouring 2h+1 magnitude spectrum points, $magnitude_p^{max}=\max(magnitude_{p-h \ldots p+h})$; and d) The maximum value of the neighboring 2h+1 Absorption spectrum profile points $absorption_p^{max}=\max(absorption_{p-h \ldots p+h})$ Preferably, the weighting, A(p) is given by:

$$A(p) = 0.5 + 0.5 \cdot \left( \frac{absorption_p}{absorption_p^{max}} \cdot \frac{magnitude_p}{magnitude_p^{max}} \right)$$

Other functions may be used, such as:

$$A(p) = 0.5 + 0.5 \cdot \left( \frac{absorption_p}{absorption_p^{max}} \cdot \frac{magnitude_p}{magnitude_p^{max}} \right)^n$$

where n is typically in the range from 0 to 10.

Figure 10:
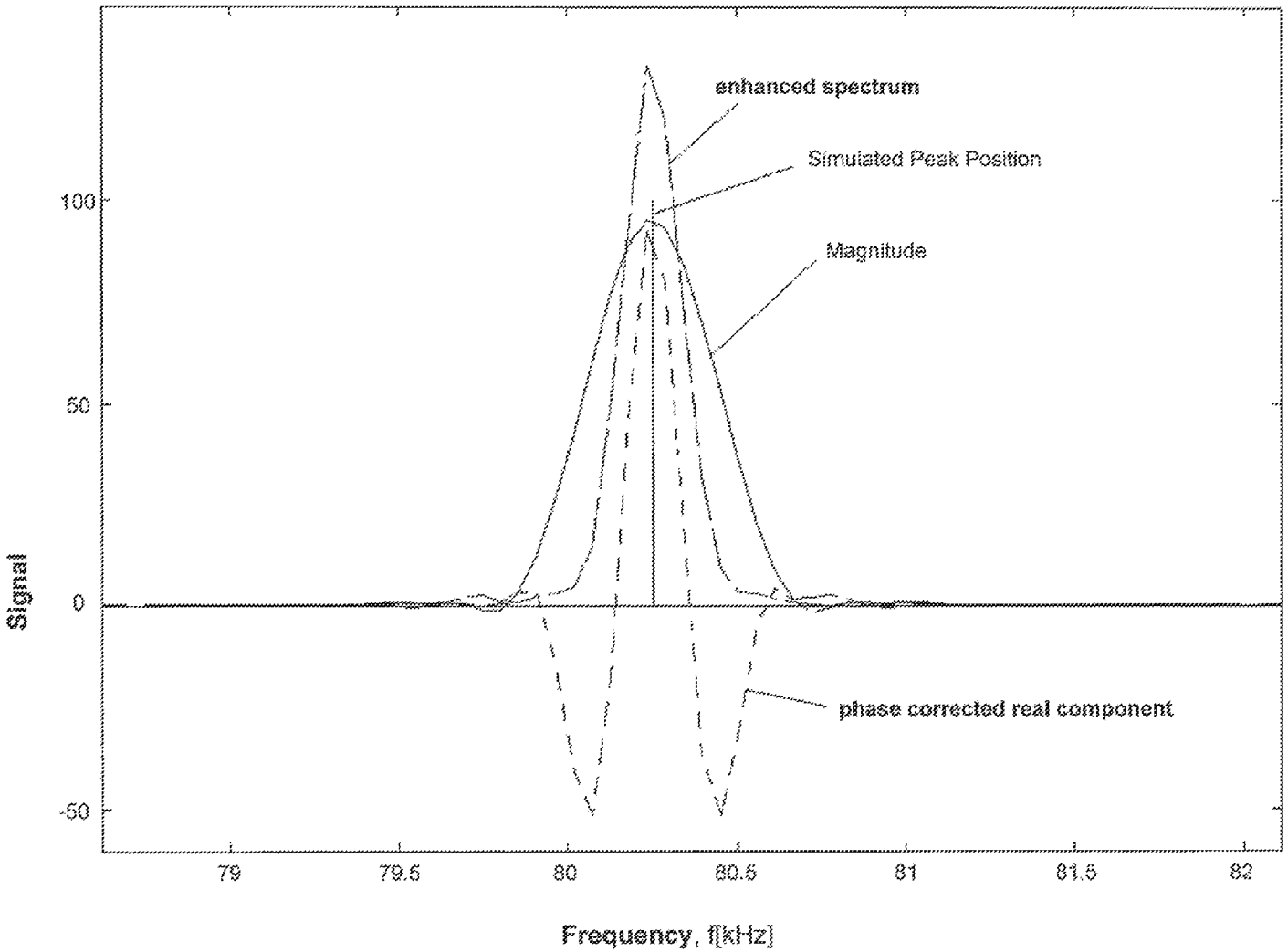
FIG. 10 shows an enhanced spectrum, along with curves for the corresponding magnitude spectrum, phase corrected real component, and position of a simulated peak.

An enhanced spectrum is shown in FIG. 10, along with curves for the corresponding magnitude spectrum, phase corrected real component (Absorption spectrum), and position of a simulated peak derived using an artificial, ideal sine-shaped transient. The enhanced spectrum shows enhanced resolution compared to the magnitude spectrum but does not show the sidelobes of the real component alone and does not contain negative values. It can be seen that, advantageously, the negative nature of the sidelobes of the absorption spectrum is to a significant extent naturally compensated out of the enhanced spectrum by the magnitude spectrum with which it is summed, thus reducing spectral leakage into the sidelobes.

As an optional step for further improvement of the sidelobe appearance, the enhanced spectrum algorithm preferably adds a correction to each point of the enhanced spectrum. This correction is calculated as a weighted sum of a plurality of neighbouring points in the spectrum (ii). A weighted sum of the absolute values of the neighbouring points in the spectrum (ii) is preferably also added, i.e. preferably a weighted sum of a plurality of neighbouring points and a weighted sum of the absolute values of the neighbouring points are added to each point, thus making it two weighted sums added to each point. This method of calculating weighted sums from neighbouring points is known in the art as "finite-impulse-response" (FIR) filtering, and is described in signal processing textbooks, such as Lyons R. G.(ed.), *Understanding Digital Signal processing* (*Prentice Hall*), 2004 (see Chapter 5 therein). The coefficient for the weighted sum or FIR coefficients may be calculated as described below.

This FIR filtering or weighted sum correction for a point of the enhanced spectrum in certain preferred embodiments may be calculated according to:

$$ES(p)^{CORR1} = \sum_{i=-h}^{+h} k_i^{corr1} y_{p+i}$$

wherein $ES(p)^{CORR1}$ is the FIR filtering or weighted sum correction, $y_{p+i}$ are the values of the neighbouring points of the spectrum (ii) from −h to +h and $k_i^{corr1}$ is the FIR coefficient.

A weighted sum of the absolute values of the neighbouring Absorption spectrum profile points is preferably alternatively or additionally, more preferably additionally, added as a further correction, which further correction in certain preferred embodiments may be calculated according to:

$$ES(p)^{CORR2} = \sum_{i=-h}^{+h} k_i^{corr2} |y_{p+i}|$$

wherein $ES(p)^{CORR2}$ is the FIR filtering or weighted sum correction for the absolute values, $|y_{p+i}|$ are the absolute values of the neighbouring points of the spectrum (ii) from −h to +h and $k_i^{corr2}$ is the FIR coefficient.

In the above equations, $k_i^{corr1}$ and $k_i^{corr2}$ are the FIR coefficients and their determination is described below. This particular FIR-filter is similar in effect to the so called "Frequency-Domain windowing" in Ch. 13.3. of Lyons. The FIR corrected enhanced spectrum profile, ES(p), may then be calculated as:

$$ES(p)=ES(p)^{Weighted}+ES(p)^{CORR1}+ES(p)^{CORR2}$$

where $ES(p)^{weighted}$ is the enhanced spectrum without FIR filtering, e.g. as described above.

Figure 11:
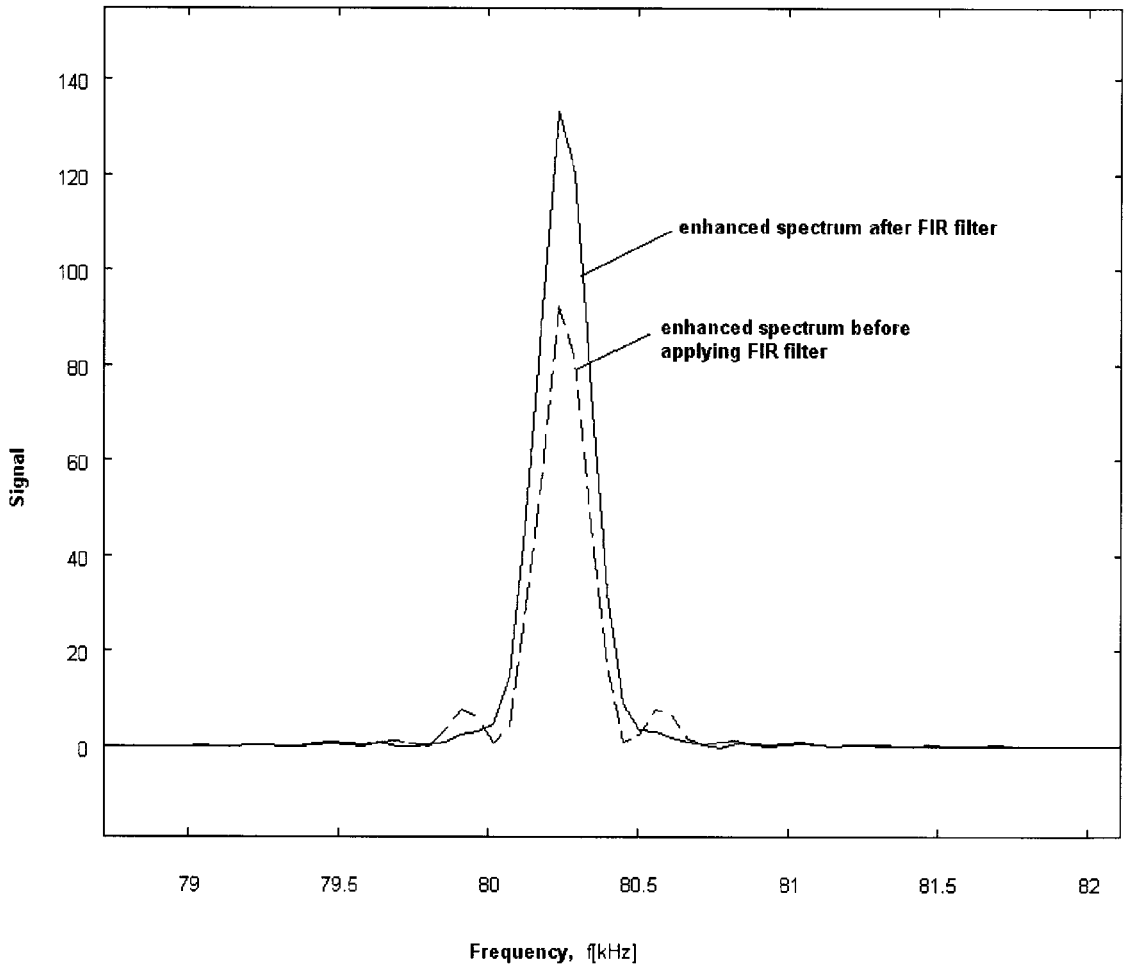
FIG. 11 shows an enhanced spectrum profile before and after FIR filtering.

FIG. 11 shows an enhanced spectrum profile before (i.e. $ES(p)^{weighted}$) and after (i.e. ES(p)) FIR filtering, where the effect of the FIR filtering can be seen as reducing residual sidelobes even further.

Figure 12:
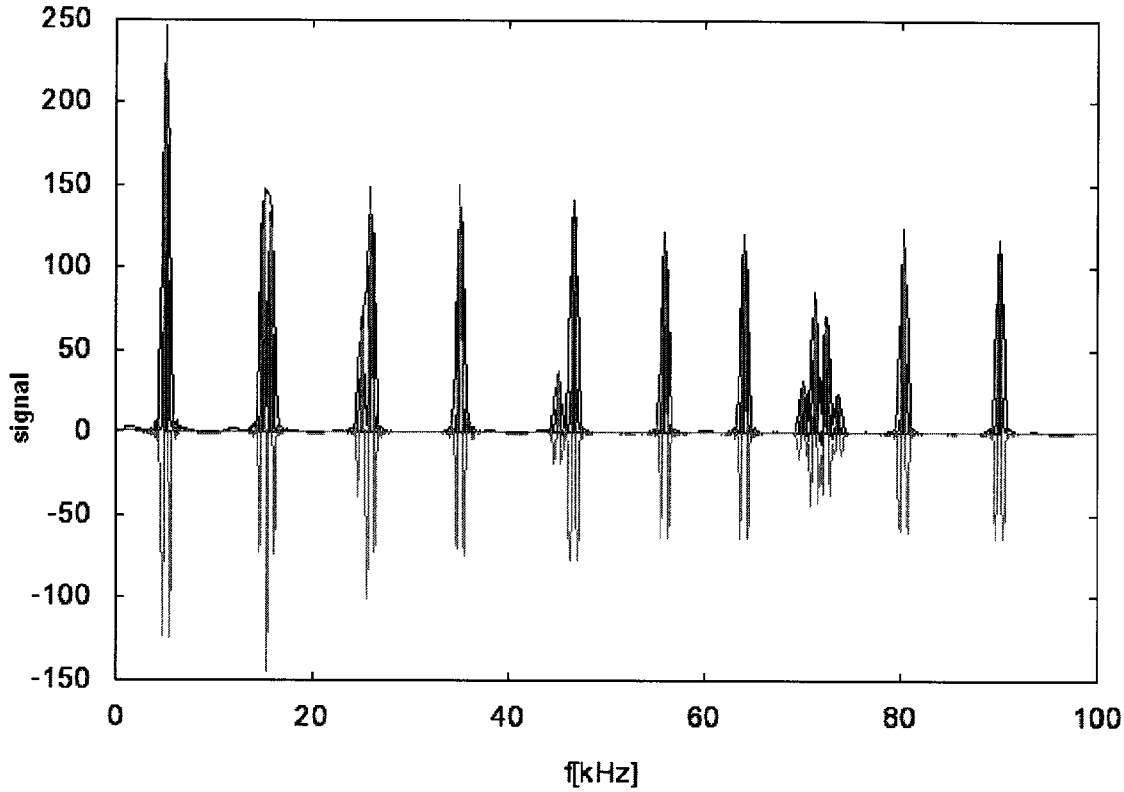
FIG. 12 shows a typical model spectrum for calculating FIR coefficients.

The coefficients for the weighted sum, also known as the FIR coefficients, may be typically pre-calculated, e.g. using simulated peaks in a try-and-error manner. The simulation includes single peaks as well as multiple neighbouring peaks with different distances. The coefficients (k) for the weighted sum or FIR coefficients are thus preferably obtained using a method (preferably implemented in software which can be run on a computer, e.g. a computer of the apparatus or other computer from which the coefficients may be copied over to the apparatus) that simulates the described process of calculating the enhanced spectrum, i.e. to produce a model spectrum on which a method such as the following may be applied to determine the FIR coefficients. A typical model spectrum for calculating FIR coefficients using the above method is shown in FIG. 12. The model spectrum contains numerous model peaks, including some distinct single peaks as well as some multiple peaks. The model spectrum used for the simulation preferably consists of multiple peaks (i.e. constructed from multiple sine-shaped transients). The peaks preferably have different relative positions and heights. The reason for this is to simulate "real-word" spectra that have multiple peaks influencing each other.

The FIG. 12 shows the real components of the peaks, as well as the magnitude profile and the calculated enhanced spectrum with calculated peak positions. Subsequently, for the determination of the FIR coefficients, for example, in a first modification loop starting with all FIR coefficients, k, set to zero, a small modification is added to the first coefficient, and the resulting enhanced spectrum profile evaluated. This evaluation preferably includes measuring the side lobe height and resolution of the peak and optionally other factors as described below. If the modification of the coefficient did not improve the evaluated profile, then the modification is revoked. Otherwise, the modification is retained and then the next coefficient is modified and the result evaluated. When this has been done with all coefficients, the method goes back to the first coefficient and starts again, i.e. in a second modification loop, and applies another modification, which may be a smaller modification than the modification in the first modification loop. This process preferably continues until the modifications are finally smaller than a given stop value.

From the above it can be seen that the weighted sums or FIR coefficients may be determined by the following method steps:

i) provide a simulated enhanced spectrum (preferably having single and multiple neighbouring peaks);

ii) in a first modification loop:

a. apply a small modification to a first FIR coefficient, re-calculate the enhanced spectrum and evaluate the quality of the resulting enhanced spectrum;

b. if the evaluation in a. determines that the quality is not improved then discard the said modification and choose a different modification for the first coefficient and repeat a., or if the evaluation in a. determines that the quality is improved repeat a. and b. for the next coefficient;

c. repeat a. and b. until all coefficients have been modified;

iii) return to the first coefficient again and repeat ii) for another modification loop;

iv) repeat ii) and iii) until one or more of the modifications become smaller than a given stop value.

Other algorithms, e.g. genetic algorithms, could be used to optimise the coefficients. The modified FIR coefficients, k, resulting from the above method may thus be used to correct the real enhanced spectrum.

The evaluation (i.e. the optimization goal) for the simulation process above to optimise the FIR coefficients preferably takes into consideration one or more of: the sidelobe height, peak resolution, accuracy of the peak position, and accuracy of the height. More preferably, for the evaluation of the resulting enhanced spectrum after modification of one or more coefficients, the method calculates a score that reflects the quality of the result, in order to see whether the result was improved or became worse compared to the spectrum before said modification. The score more preferably includes a sum of:

I. a value representing the summed height of the sidelobes;

II. a value representing the number of observed sidelobes;

III. a value representing the resolution of the observed enhanced spectrum peaks;

IV. a value representing the correctness of the peak's height compared to a model peak; and V. a value representing the correctness of the peak's spectral position compared to the model peak.

The model peak used for IV. and V. above is the corresponding peak used as the input for the simulation (model spectrum) (i.e. a peak calculated using a sine-shaped signal to simulate a peak in the model spectrum). The height corresponds to the amplitude of the simulated sine-shaped signal.

Baseline roll can be a significant problem for FT-ICR, where the delay between excitation and detection is typically quite substantial. However, the problem is less significant in the case of Orbitrap™ mass analysers due to the short delay between ion injection and detection. The spectral leakage of a baseline roll phenomenon is typically within the noise level for Orbitrap™ mass analysers and hence usually need not be corrected for. In the case of FT-ICR mass analysers and other mass analysers, if necessary, methods of correction for baseline roll may be employed with the present invention. Examples of correction include the method of "backward linear prediction". Linear prediction is a well known method for processing of FT-spectra and comprises construction of additional transient points from the existing transient. This is used in FT-Infrared (FT-IR) where it is also known as LOMEP or Burg's impulse response. Backward linear prediction is already used in FT-NMR to restore the single point at the start of the transient that's typically missing in NMR detection as described in Kauppinen, J. & Partanen, J., Fourier Transforms in Spectroscopy, Wiley-VCH, 2001, p. 255). Backward linear prediction would be a convenient way of dealing with baseline roll.

For the frequency (or m/z) assignment of a peak (also known as a centroid or label) in the enhanced spectrum, values from the spectrum (i) or the spectrum (ii) may be used or a mixture of both may be used. The centroid frequency or centroid m/z values from the spectrum (i) or the spectrum (ii) may be used for this purpose. It has been found that in some cases errors in determining the initial phase can cause errors in the mass accuracy of a final spectrum derived using phase corrected data. Accordingly, it is preferred that one of the following methods is used for the frequency (or m/z) assignment of a peak in the enhanced spectrum. In a preferred peak assignment method m/z or frequency assignments for the enhanced spectrum are improved using m/z or frequency assignments from spectrum (i). In a more preferred peak assignment method, it has been found to be safe and reliable to take the standard frequency (or m/z) assignment of the corresponding peak in the spectrum (i) (preferably magnitude spectrum) as the assignment of the frequency (or m/z) of a peak in the enhanced spectrum, where the peak in the enhanced spectrum is an undisturbed peak (e.g. a pure single peak) and to take the frequency (or m/z) of the peak from the enhanced spectrum as the assignment of the frequency (or m/z) of a peak in the enhanced spectrum, where the peak in the enhanced spectrum is a disturbed peak (i.e. other than a pure single peak, such as, e.g., part of a double peak or doublet, or peak with a shoulder etc.). In another optional peak assignment method, which can be used for peak assignment in any or all of spectrum (i) (preferably magnitude spectrum), spectrum (ii) and the enhanced spectrum, is to use peak fitting, e.g. to a model peak or to an (average) observed peak shape. In still other optional peak assignment methods, other phase insensitive estimators exist for direct operation on complex data, e.g. as described in Lyons R. G., *Understanding Digital Signal processing* (*Prentice Hall*) 2004. The aforementioned errors in determining the initial phase typically have more negative effects for the low m/z range of the spectrum than for the high m/z range. Therefore, an option is to calculate the enhanced spectrum such that the enhanced spectrum emphasises more the spectrum (i) (preferably magnitude spectrum) in a low m/z range (i.e. resolution enhancement is diminished for peaks in a low m/z range). This means trading some resolution enhancement for better peak shape and mass accuracy in the low m/z range. Thus, preferably, the enhanced spectrum includes a weighting factor for the sum of the spectrum (i) and spectrum (ii) which is dependent on the frequency or m/z value. Accordingly, optionally, one or both of the weighting factors, e.g. A(f) and B(f), for the enhanced spectrum are dependent on the frequency or m/z value.

With regard to other features, the apparatus of the present invention preferably comprises means to decouple the detector from pulses which may be caused by ion injection and/or other trap related events (e.g. capacitative balancing by design of the analyser and detector and/or correction capacitances).

Preferably, to minimise errors in phase correction, detection of the transient should commence, in order of increasing preference, within 10, within 5, within 3, within 2, within 1, within 0.5, within 0.1 μs of the ion injection (e.g. from a trigger signal generated substantially simultaneously with ion injection). Expressed in other way, the detection of the transient should preferably commence, in order of increasing preference, within 1000, within 100, within 10, within 1 cycles of the highest detected frequency component.

The mass analyser of the present invention may be used for analysing ions of compounds which have been previously subject to an earlier analysis or separation method such as liquid or gas chromatography. Accordingly, the present invention may be utilised with hybrid mass spectrometry techniques such as LC-MS, GC-MS, as well as tandem mass spectrometry ($MS^2$) or $MS^n$ techniques.

Advantageously, examples using the enhanced spectrum of the present invention have shown a 2 fold enhancement of resolving power. Approximately, an up to 2-fold enhancement is seen to be due to the effective use of a phase corrected complex spectrum (i.e. "Absorption" spectrum) instead of the "magnitude" spectrum alone, with a further slight increase in resolution due to the choice of window function and FIR filtering. Reduction of sidelobes and reduction of spectral leakage are accompanying features of the present invention. In other words, the invention delivers the improved resolution of the "Absorption" spectrum but alleviates the disadvantages associated with using that spectrum alone, especially the present invention greatly reduces problems, e.g. relating to spectral leakage and associated with sidelobes in apodised absorption spectra. The enhanced spectrum has essentially the same ratios between mass peaks (e.g. isotopic peaks) as the magnitude spectrum and therefore may be used for quantitation measurements. Due to improved resolution and better peak shape, the use of the enhanced spectrum may improve quantitation.

An example of the present invention will now be described, which is non-limiting on the scope of the invention.

A method according to the present invention was performed using an Orbitrap™ mass analyser instrument from Thermo Fisher Scientific with processing of the data performed on the instrument computer which was programmed to perform the data processing steps of the present invention.

Figure 13:
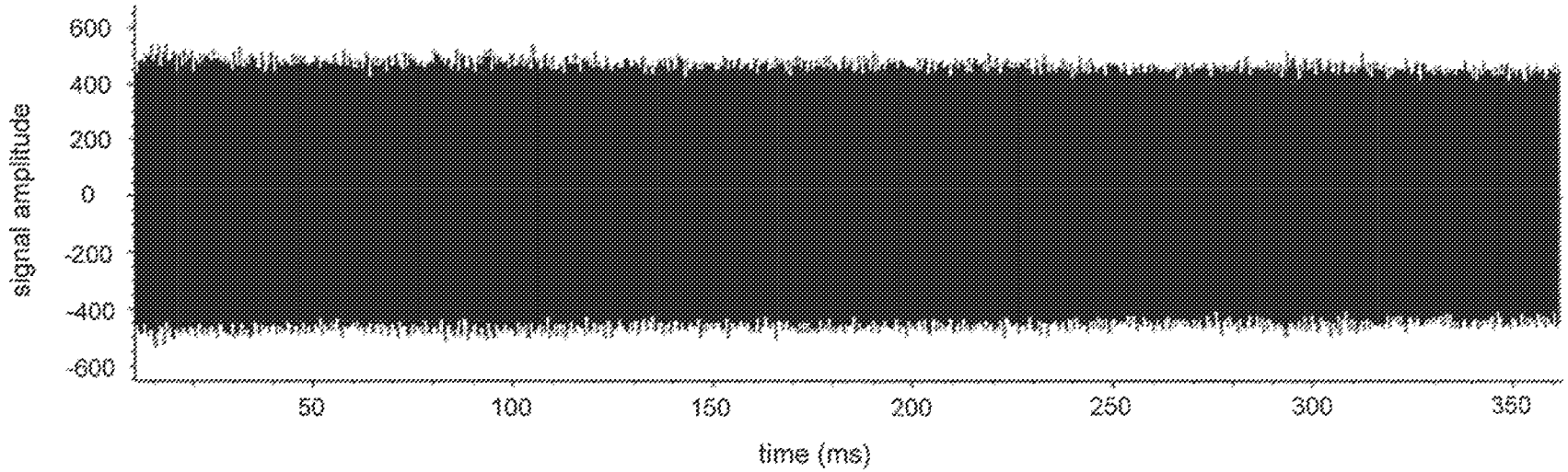
FIG. 13 shows a transient signal of a calibration mixture acquired using an Orbitrap™ mass analyser.
Figure 14:
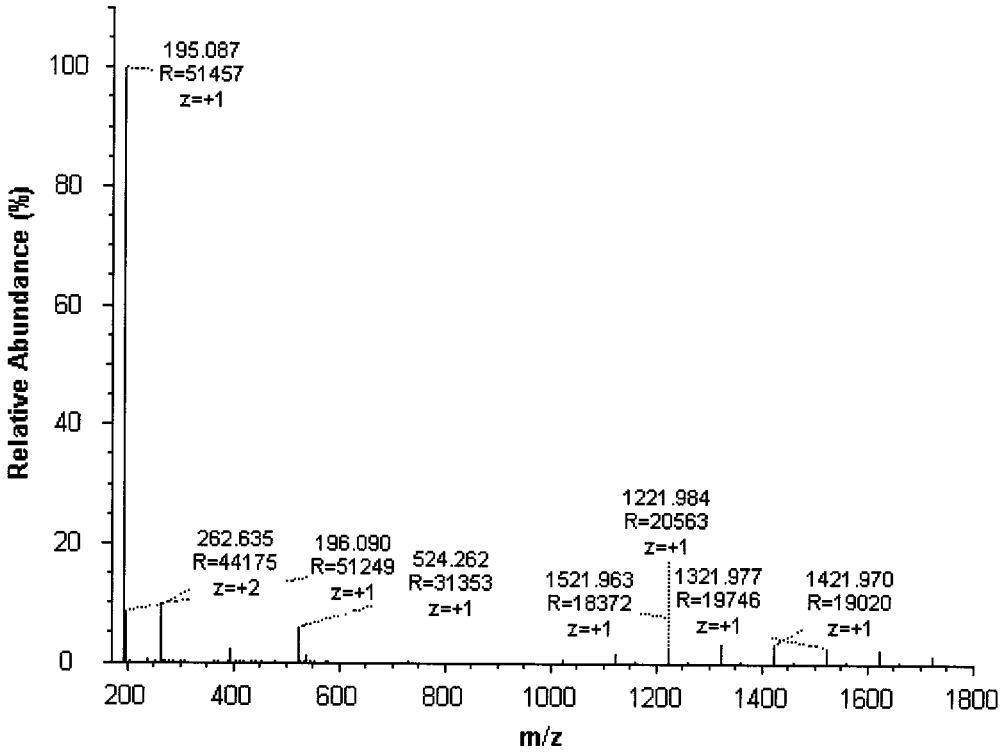
FIG. 14 shows a magnitude spectrum derived following the Fourier transformation of the transient of FIG. 13 and converted to the m/z domain.
Figure 15:
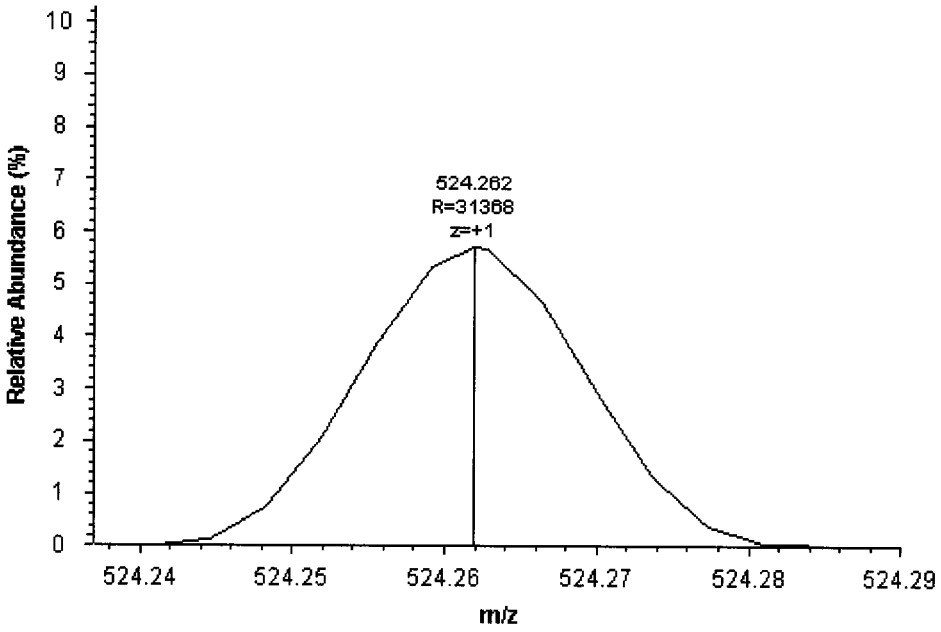
FIG. 15 shows a magnified view in the magnitude spectrum of FIG. 14 in the region of the MRFA peptide ion peak.

A calibration mixture including caffeine, the peptide MRFA and the compound "Ultramark™" (a commercially available mixture of fluorinated phosphazenes) was ionised and analysed using the Orbitrap™ mass analyser. The acquired transient signal of the calibration mixture is shown in FIG. 13. The transient was then Fourier transformed on the computer by FFT algorithm to obtain a complex spectrum from which the magnitude spectrum and the enhanced spectrum could then be calculated. The conventional magnitude spectrum derived following the Fourier transformation and converted to the m/z domain is shown in FIG. 14. In FIG. 15 is shown a magnified view in the conventional magnitude spectrum of the MRFA ion peak, which can be compared to the MRFA ion peak later obtained in the enhanced spectrum of the present invention as described below.

Figure 16:
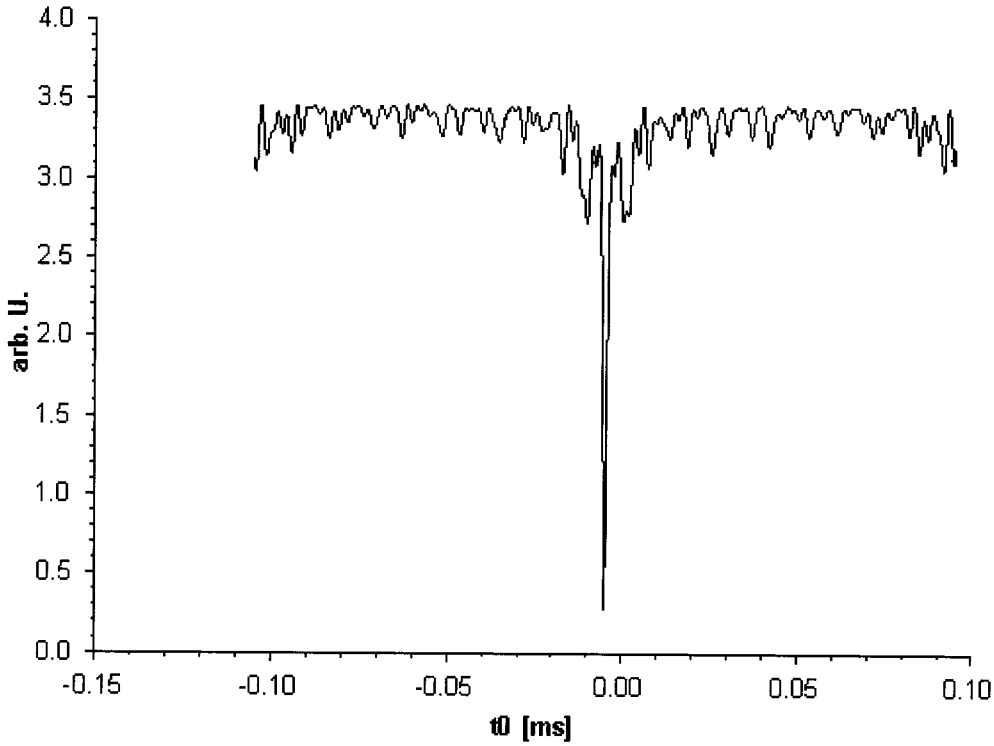
FIG. 16 shows the phase matching score for a range of test delay times to calculate the phase correction for the spectrum.

In order to calculate the enhanced spectrum, the phase correction was then determined using the method described herein. Namely, from the conventional magnitude spectrum the most abundant peaks were selected and their phase calculated. A range of test delay times was then employed to derive $t_0$ the assumed start time by identifying the test delay time with the minimum phase deviation for the selected most abundant peaks. The phase matching score for a range of the test delay times is shown in FIG. 16. The minima in the matching score indicates the time at which the phases were most closely matched and so the value of $t_0$. From $t_0$, the initial phase $\phi_0$ was also obtained as described above and used for the phase correction.

In order to further improve the phase correction quality, a phase dispersion calibration was also performed to account for small phase variations with frequency. For this purpose the phase data for the selected peaks (i.e. at different frequencies) was used from several scans. A plot of the phases for the selected peaks (frequencies) is shown for the several scans in FIG. 17. A best fit curve through the phase data provided the phase dispersion calibration which was added to the initial phase $\phi_0$ calculated above for the phase correction to provide a modified $\phi_0$ which was then used for the phase correction.

Figure 18:
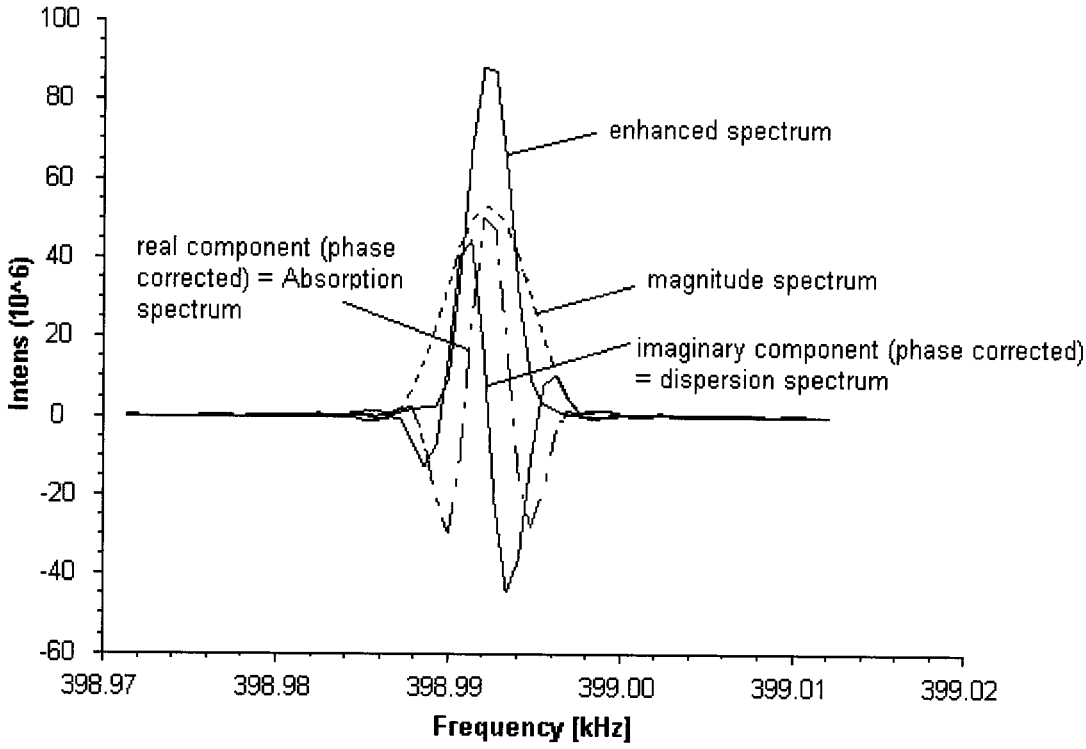
FIG. 18 shows the phase corrected absorption peak for the MRFA peptide ion, together with the phase corrected imaginary peak, the magnitude peak and the enhanced spectrum.

Using the phase correction vector of Equation (2) above with $t_0$ and $\phi_0$, the real component of the spectrum was phase corrected to provide a phase corrected absorption spectrum. In FIG. 18 is shown, in the frequency domain, the phase corrected absorption peak for the MRFA ion, along with the phase corrected imaginary peak and the magnitude peak (i.e. corresponding to the MRFA ion magnitude peak in the m/z domain shown in FIG. 15). The enhanced spectrum as described below is also shown.

The enhanced spectrum was calculated using an algorithm, which calculated the enhanced spectrum, ES(p) according to:

$$\mathrm{ES}(p)=\mathrm{ES}(p)^{Weighted}+\mathrm{ES}(p)^{CORR1}+\mathrm{ES}(p)^{CORR2}$$

which is described above, with $\mathrm{ES}(p)^{Weighted}$ being given by:

$$A(p)\cdot\mathrm{Re}(p)+[1-A(p)]\cdot\mathrm{Magnitude}(p)$$

which is also described above, with A(p) being given by:

$$A(p)=0.5+0.5\cdot\left(\frac{absorption_p}{absorption_p^{max}}\cdot\frac{magnitude_p}{magnitude_p^{max}}\right)$$

also described above.

The value of the term h for setting the number of neighbouring points for consideration in the calculation was set to 8. The FIR coefficients used for the correction terms $\mathrm{ES}(p)^{CORR1}+\mathrm{ES}(p)^{CORR2}$ were:

$k^{corr1}$=re_coeff=[0.530901322465, 0.580128992718, 0.339791225501, 0.2242425857, 0.35068536902, 0.0988045218695, 0.0615432157906, 0.0673185581260, 0.0535519621698];

$k^{corr2}$=abs_re_coeff=[0.0870738221997, 0.0424013254304, 0.012047638844, 0.0454330262977, 0.0290721381448, 0.083588550875, 0.026685276687, 0.0435414796066, 0.0584666527771]. The same FIR coefficients were used for points at +h and −h, i.e. the coefficients are symmetrical in order to try to achieve symmetrical peaks.

The enhanced spectrum thus calculated is also shown in FIG. 18 for the MRFA ion. The enhanced resolution compared to the conventional magnitude spectrum is clearly to be seen and the enhanced spectrum clearly lacks the sidelobes present in the pure absorption spectrum (real component).

Figure 19:
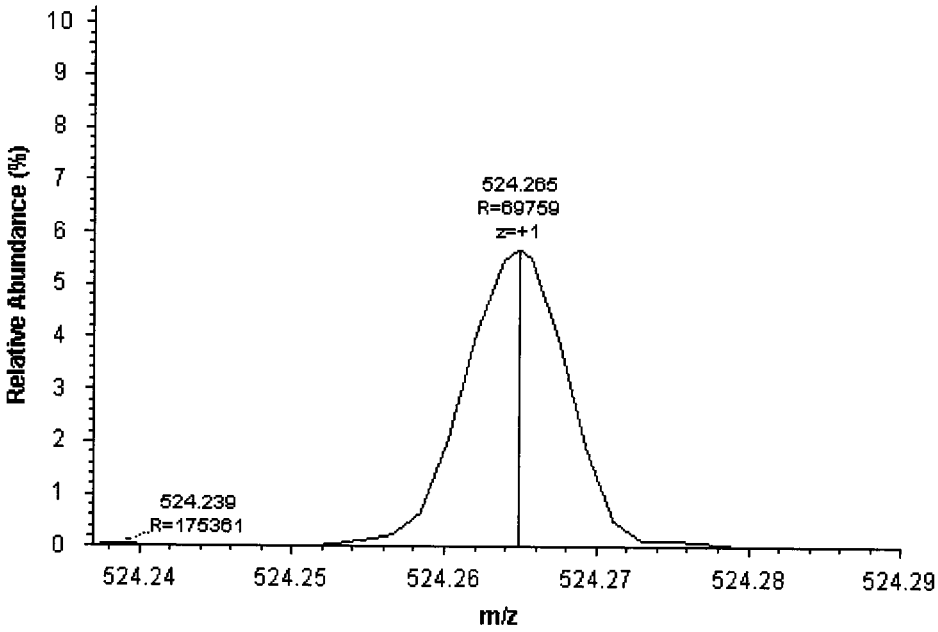
FIG. 19 shows an expanded view of the resulting enhanced mass spectrum of the MRFA ion after phase correction.

Conversion of the enhanced spectrum in the frequency domain to the m/z domain was performed and the resulting mass spectrum is shown in FIG. 19, which shows an expanded view of the enhanced mass spectrum for the same MRFA ion as above. The resolution is clearly improved compared to the magnitude peak profile for the MRFA ion shown in FIG. 15 and the enhanced spectrum profile does not show any significant sidelobes.

Figure 20:
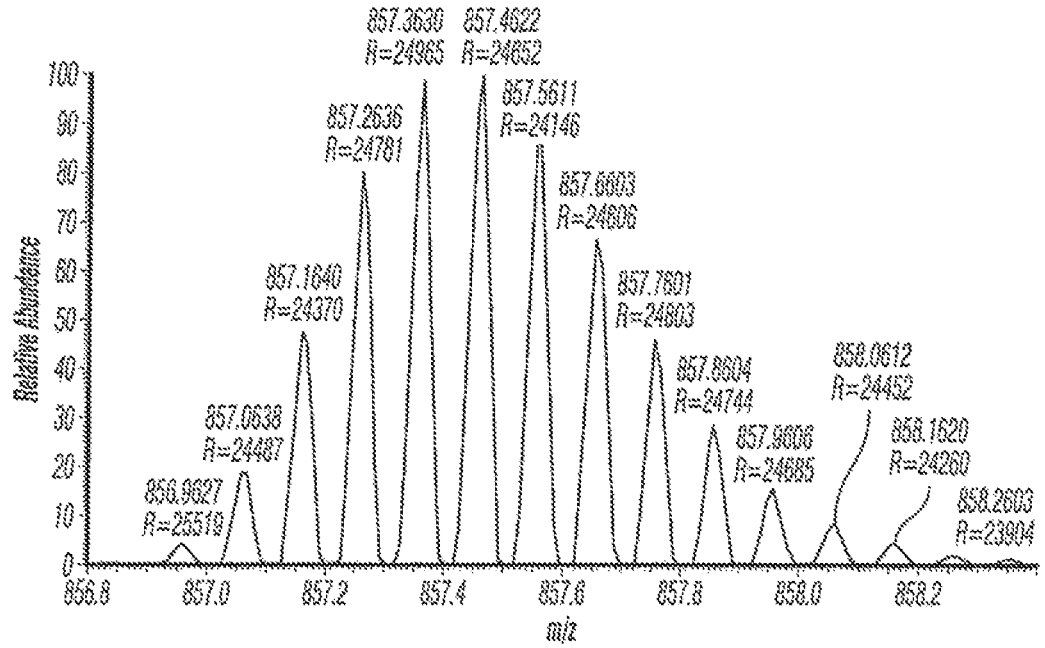
FIG. 20 shows a comparison of a spectrum obtained without using the present invention and a spectrum obtained with the present invention.
Figure 20:
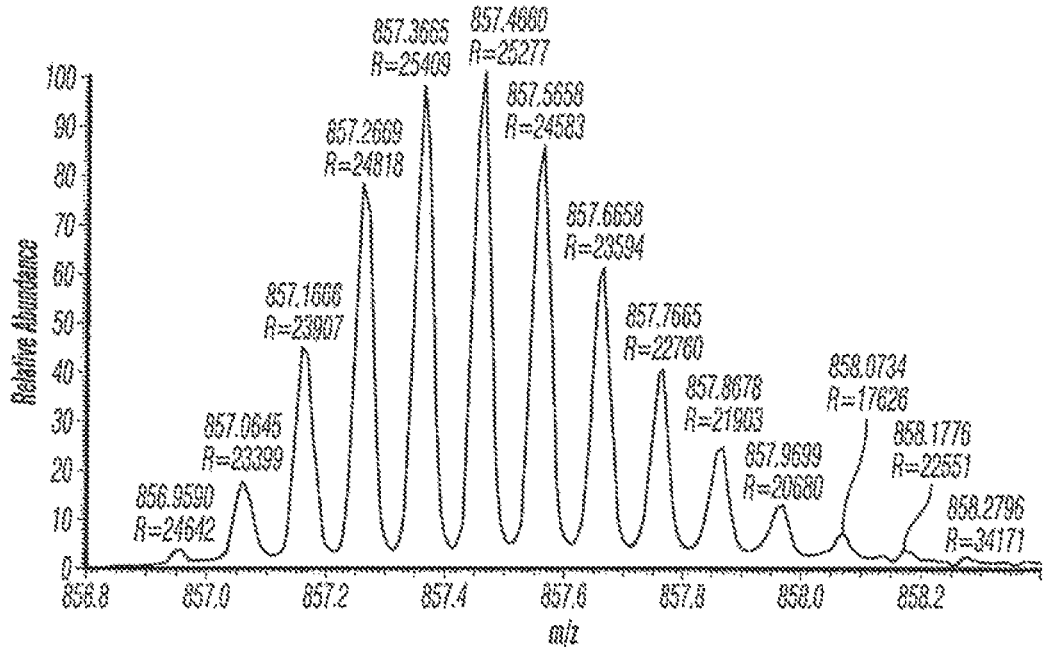

FIG. 20 shows a comparison of a mass spectrum of ubiquitin obtained without using the present invention (bottom spectrum) and a spectrum obtained with the present invention (top spectrum). The spectrum obtained with the present invention shows comparable resolution to the spectrum obtained without using the present invention but the spectrum obtained with the present invention was acquired using only half as much detection time. This is especially beneficial for high-resolution analysis of intact proteins and other analytes with limited life-time in the analyser. Accordingly, beneficially the invention may be used for improving analysis of analytes having a significant probability of decay during the oscillation of their ions within the analyser. The spectrum obtained with the present invention also shows no apodisation effects, accurate assignment of isotopes, improved signal-to-noise ratio, absence of baseline between isotopic peaks.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. A method of producing a mass spectrum, comprising:

causing ions to undergo oscillations within a mass analyser;

obtaining a transient representative of the oscillation of ions;

using a suitably programmed information processor, Fourier transforming the transient to obtain a complex spectrum; and using the suitably programmed information processor, calculating an enhanced spectrum having a resolution higher than that of a Magnitude spectrum calculated from the complex spectrum, which comprises a combination of spectrum (i) and spectrum (ii) wherein spectrum (i) comprises a Positive spectrum obtained from the complex spectrum; and spectrum (ii) comprises an Absorption spectrum obtained from the complex spectrum.

2. A method as claimed in claim 1, wherein spectrum (i) comprises a function $Re(p)^2+Im(p)^2$, wherein Re(p) is the real component of the complex spectrum and Im(p) is the imaginary component of the complex spectrum.

3. A method as claimed in claim 2, wherein spectrum (i) comprises the Magnitude spectrum or the Power spectrum.

4. A method as claimed in claim 1, wherein the Absorption spectrum is obtained after a phase correction is applied to the complex spectrum by multiplying data points of the complex spectrum by the corresponding values of a phase correction vector which is a function of the assumed start time when all components of the transient are assumed to be in phase (to) and the phase at the assumed start time ($\phi_0$).

5. A method as claimed in claim 4, wherein the phase correction vector comprises the vector:

$$\text{Magnitude}(f)=1;\ \text{Phase}(f)=\phi_0+2\pi f t_0$$

where:

Magnitude(f) is the vector component for the magnitude of a frequency component f of the complex spectrum;

Phase(f) is the vector component for the phase of a frequency component f of the complex spectrum;

$\phi_0$ is the phase (radians) of the frequency component f at $t_0$;

f is the frequency (seconds$^{-1}$) of the frequency component; and $t_0$ is the assumed start time (seconds) when all frequency components are assumed to be in-phase.

6. A method as claimed in claim 4, wherein the phase correction is applied by:

selecting multiple points in time preceding the start of detection of the transient;

determining for each selected point in time a measure of the deviation of phases of selected multiple components of the transient;

determining the point in time, the assumed start $t_0$, at which the measure of the deviation of phases is substantially at a minimum;

determining the phase, $\phi_0$, of each of multiple components of the transient at $t_0$; and applying a phase correction to the complex spectrum using a function of $t_0$ and $\phi_0$.

7. A method of as claimed in claim 6, wherein the selected multiple components of the transient are selected as corresponding to peaks in spectrum (i) above a pre-determined intensity threshold.

8. A method as claimed in claim 4, comprising adjusting the value of $\phi_0$ by a phase dispersion calibration which is measure of the residual deviation of the phases of the transient components at $t_0$.

9. A method as claimed in claim 1, wherein the enhanced spectrum comprises a weighted sum of (i) and (ii).

10. A method as claimed in claim 1, wherein the enhanced spectrum is calculated point by point and the combination of spectrum (i) and spectrum (ii) is determined point by point.

11. A method as claimed in claim 9, wherein the enhanced spectrum is calculated by using a weighting for summing spectrum (i) and spectrum (ii) which emphasises the spectrum (i) near to peak edges and emphasises spectrum (ii) near to peak centres.

12. A method as claimed in claim 9, wherein the weightings of the spectra (i) and (ii) for each point of the enhanced spectrum are determined based on the intensity and position of one or more maxima found within a range of points of spectra (i) and/or (ii) around the point.

13. A method as claimed in claim 1, wherein each point of the enhanced spectrum comprises a combination of spectra (i) and (ii) at the point and one or more neighbouring points.

14. A method as claimed in claim 1, wherein the enhanced spectrum is further corrected by a function of points in spectrum (ii) calculated by a finite-impulse-response (FIR) filtering method.

15. A method as claimed in claim 1, wherein m/z or frequency assignments for the enhanced spectrum are improved using m/z or frequency assignments from spectrum (i).

16. A method as claimed in claim 15, wherein the m/z assignment of a peak in the enhanced spectrum is taken to be the m/z assignment of the corresponding peak from the spectrum (i) where the peak in the enhanced spectrum is an undisturbed peak and taken to be the m/z assignment of the peak from the enhanced spectrum where the peak in the enhanced spectrum is a disturbed peak.

17. A method as claimed in claim 1, wherein the method is used for improving analysis of analytes having a significant probability of decay during the oscillation of their ions within the analyser.

18. A method as claimed in claim 1, comprising outputting data representative of the enhanced spectrum.

19. A method of producing a phase corrected complex spectrum from a complex spectrum obtained by Fourier transformation from a detected transient obtained from a mass analyser, comprising:

(a) using a suitably programmed information processor, selecting multiple points in time preceding the start of detection of the transient;

(b) using the suitably programmed information processor, determining for each selected point in time a measure of the deviation of phases of selected multiple components of the transient;

(c) using the suitably programmed information processor, determining the point in time, $t_0$, at which the measure of the deviation of phases is substantially at a minimum;

(d) using the suitably programmed information processor, determining the phase, $\phi_0$, of each of multiple components of the transient at $t_0$; and (e) using the suitably programmed information processor, applying a phase correction to the complex spectrum using a function of $t_0$ and $\phi_0$ to obtain the phase corrected complex spectrum.

20. A method as claimed in claim 19, wherein step (b) comprises determining a phase correction value from frequency and time for each component selected, applying this phase correction to create an absorption spectrum for each component, calculating a distance between the peak maxima of each component as observed in the magnitude spectrum and the peak maxima observed in the absorption spectrum, and adding the distances to form the measure.

21. An apparatus for producing a mass spectrum, comprising:

a mass analyser for causing ions to oscillate therein;

a detector for obtaining a transient from oscillation of the ions in the mass analyser; and a suitably programmed information processor for Fourier transforming the transient to obtain a complex spectrum and calculating an enhanced spectrum having a resolution higher than that of a Magnitude spectrum calculated from the complex spectrum, which comprises a combination of spectrum (i) and spectrum (ii) wherein spectrum (i) comprises a Positive spectrum obtained from the complex spectrum; and spectrum (ii) comprises an Absorption spectrum obtained from the complex spectrum.

22. An apparatus as claimed in claim 21, wherein the mass analyser comprises an ion trap.

23. An apparatus as claimed in claim 22, wherein the mass analyser comprises any of: an FT-ICR mass analyser, a mass analyser in which ions oscillate within a hyper-logarithmic electric field, a mass analyser in which ions oscillate axially along an electrode within the analyser whilst orbiting around the electrode, a Cassinian trap, a linear trap and a reflectron trap.

24. An apparatus as claimed in claim 22, comprising an ion injection device for simultaneously injecting ions into the ion trap whereby the ions are induced to oscillate within the ion trap upon injection.

25. An apparatus as claimed in claim 22, wherein the mass analyser comprises a mass analyser in which ions oscillate axially along an electrode within the analyser whilst orbiting around the electrode.

26. A method as claimed in claim 5 wherein the phase correction is applied by:

using the suitably programmed information processor, selecting multiple points in time preceding the start of detection of the transient;

using the suitably programmed information processor, determining for each selected point in time a measure of the deviation of phases of selected multiple components of the transient;

using the suitably programmed information processor, determining the point in time, the assumed start to, at which the measure of the deviation of phases is substantially at a minimum;

using the suitably programmed information processor, determining the phase, $\phi_0$, of each of multiple components of the transient at $t_0$; and using the suitably programmed information processor, applying a phase correction to the complex spectrum using a function of $t_0$ and $\phi_0$.

* * * * *